US006214509B1

(12) United States Patent
Kasuya et al.

(10) Patent No.: US 6,214,509 B1
(45) Date of Patent: Apr. 10, 2001

(54) TONER AND IMAGE FORMING METHOD

(75) Inventors: Takashige Kasuya, Shizuoka-ken; Tsutomu Kukimoto, Yokohama; Satoshi Yoshida, Tokyo; Hiroshi Yusa, Machida; Manabu Ohno, Numazu; Tsuyoshi Takiguchi, Shizuoka-ken; Yuki Karaki, Shizuoka-ken; Satoshi Handa, Shizuoka-ken; Masanori Ito, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/310,949

(22) Filed: May 13, 1999

(30) Foreign Application Priority Data

May 13, 1998 (JP) ..... 10-129780
May 13, 1998 (JP) ..... 10-129781

(51) Int. Cl.[7] ..... G03G 9/097; G03G 13/16
(52) U.S. Cl. ..... 430/110; 430/111; 430/126
(58) Field of Search ..... 430/106, 109, 430/110, 111, 126

(56) References Cited

U.S. PATENT DOCUMENTS

| | | | | |
|---|---|---|---|---|
| 5,244,764 | * | 9/1993 | Uno et al. | 430/110 |
| 5,250,380 | * | 10/1993 | Bayley et al. | 430/110 |
| 5,288,581 | * | 2/1994 | Ziolo | 430/110 |
| 5,501,931 | * | 3/1996 | Hirama et al. | 430/109 |

FOREIGN PATENT DOCUMENTS

| | | |
|---|---|---|
| 10231 | 7/1961 | (JP) . |
| 104351 | 8/1981 | (JP) . |
| 178257 | 11/1982 | (JP) . |
| 040566 | 3/1983 | (JP) . |
| 139156 | 8/1983 | (JP) . |
| 150975 | 9/1983 | (JP) . |
| 053856 | 3/1984 | (JP) . |
| 061842 | 4/1984 | (JP) . |
| 133573 | 7/1984 | (JP) . |
| 279864 | 12/1986 | (JP) . |
| 203182 | 9/1987 | (JP) . |
| 133179 | 6/1988 | (JP) . |
| 149669 | 6/1988 | (JP) . |
| 235953 | 9/1988 | (JP) . |
| 020587 | 1/1989 | (JP) . |
| 1-12253 | 4/1989 | (JP) . |
| 1-91156 | 8/1989 | (JP) . |
| 2-84158 | 1/1990 | (JP) . |
| 123385 | 5/1990 | (JP) . |
| 2-14156 | 8/1990 | (JP) . |
| 2-302772 | 12/1990 | (JP) . |
| 181952 | 8/1991 | (JP) . |
| 162048 | 6/1992 | (JP) . |
| 002289 | 1/1993 | (JP) . |
| 053482 | 3/1993 | (JP) . |
| 061383 | 3/1993 | (JP) . |
| 138697 | 5/1994 | (JP) . |
| 2584306 | 2/1997 | (JP) . |
| 2682331 | 8/1997 | (JP) . |

OTHER PUBLICATIONS

Database WPI, Section Ch, Week 199032, Derwent Publ., AN 1990–242585, XP002126694 for JP 03–216461.
Database WPI, Section Ch, Week 199150, Derwent Publ., AN 1991–365255, XP002126695 for JP 03–245158.
Patent Abstracts of Japan, vol. 17, No. 631 (P–1648), Nov. 1993 for JP 05–204186.

* cited by examiner

*Primary Examiner*—John Goodrow
(74) *Attorney, Agent, or Firm*—Fitzpatrick, Cella, Harper & Scinto

(57) ABSTRACT

The objects of the present invention are to provide a toner excellent in transferability, little remaining on the photosensitive member and causing no defective image in roll-aided transfer (or at least such a phenomenon is well-controlled), and also to provide an image forming method using the same toner.

The above objects are achieved when the toner contains a binder resin and colorant, inorganic fine particles, and a hydrotalcite compound shown by the formula:

$$M1_{y1}{}^{2+}M2_{y2}{}^{2+} \ldots Mj_{yj}{}^{2+}L1_{x1}{}^{3+}L2_{x2}{}^{3+} \ldots Lk_{xk}{}^{3+}(OH)_2.(X/n)A^{n-}.mH_2O \quad (1)$$

wherein $0<[X=(x1+x2+ \ldots xk)]\leqq 0.5$; $Y=(y1+y2+ \ldots +yj)=1-X$; j and k are each an integer of 2 or larger; $M1^{3+}$, $M2^{3+}$, . . . and $Mj^{2+}$ are divalent metallic ions different from each other; $L1^{3+}$, $L2^{3+}$ . . . and $Lk^{3+}$ are trivalent metallic ions different from each other; $A^{n-}$ is a n-valent anion; and $m\geqq 0$), and when the image forming method in which the above toner is used comprises a charging step which charges an image carrier; latent image forming step which forms an electrostatic latent image on the charged image carrier; developing step which develops the electrostatic latent image with a toner carried by a toner carrier, to form the toner image on the image carrier; transfer step which transfers the toner image on the image carrier to a medium through or not through an intermediate medium; and fixing step which fix the toner image on the medium.

75 Claims, 6 Drawing Sheets

TONER AND IMAGE FORMING METHOD

BACKGROUND OF THE INVENTION

1. Field of the Invention

The present invention relates to a toner for various recording methods, such as those based on electrophotography, electrostatic recording, magnetic recording and toner jet recording, more particularly to a toner useful for copiers, printers and facsimiles in which a toner image is formed on an electrostatic latent image carrier and the toner image is transferred onto a medium to form the final image.

2. Related Background Art

A number of electrophotographic methods have been proposed. They generally use a photoconductive material to form an electrical latent image on an image carrier (photosensitive member) by various methods, which is developed by a toner into a visible image, transferred, as required, onto transfer medium such as paper or other media, and fixed into the toner image on the above medium by heat, pressure or the like, for copying the image.

Methods to visualize an electrical latent image include cascade, magnetic-brush and pressurization development. Another method uses a magnetic toner, which is scattered by an electric field in a space between a photosensitive member and sleeve using a rotating sleeve with a magnetic pole at the center.

The one-component developing method, dispensing with carrier particles, e.g., glass beads and iron powders, which are necessary for the two-component method, reduces size and weight of the developing device itself. Moreover, the two-component developing method needs concentration of the toner in the carrier to be kept at a constant level, and hence a device which senses the toner concentration and supplies a required quantity of the toner. This further increases size and weight of the developing device. The one-component method does not need such device, and therefore, is more desirable also in this respect.

Recently, the printing devices have been mainly represented by LED and LBP printers, for which techniques are increasingly demanded to improve resolution from the traditional level of 240 or 300 dpi to 400, 600 and further to 800 dpi. The development method is also demanded to be more precise, accordingly. The copier is also becoming more functional, and advancing in the direction of digitalization. This direction is mainly associated with laser-aided formation of electrostatic images, and also demands development methods of higher resolution and precision, as is the case with printers. The toner particles, therefore, are becoming smaller. The smaller toner particles having a specific size distribution have been developed, as disclosed by Japanese Patent Application Laid-Open Nos. 1-112253, 1-191156, 2-214156, 2-284158, 3-181952, and 4-162048.

Recently, in particular, electrophotographic color-image forming devices are going into diversified applications, as they are used more widely, and are required to produce images of higher quality. It is demanded that common photographs, catalogs and maps are copied very finely and precisely to the finest portion, without forming any crushed or broken portion.

In the advanced electrophotographic image-forming devices using digital image signals, a latent image is formed by dots of a specific potential, assembled on a surface of latent image carrier or photosensitive member, where solid-color, halftone and line sections are expressed by changing dot density. This method, however, is liable to suffer problems related to color tone, because the toner particles may not be sufficiently confined in a dot, with some particles sticking out of the dot, making it difficult to secure the toner image corresponding to a dot density at a dark or bright portion of the digital latent image. When dot size is reduced to improve resolution and hence image quality, reproducibility of a latent image formed by fine dots tends to decrease, producing an image insufficient in resolution and particularly poor color tone at high-light sections, and lacking sharpness.

Moreover, the primary charging, transfer process, in which a photosensitive contact member produced by a primary charging and transfer process using conventional corona discharge is used, is becoming the major approach for environmental considerations.

The charging means using corona discharge, e.g., those named corotron and scorotron, generates a large quantity of ozone when negative corona is formed during the discharge. Therefore, the electrophotographic device must be equipped with an ozone-capturing filter, increasing device size and running cost. These problems involved in the corona charge methods cause the problems related to image quality, e.g., distorted image caused by reduced surface resistance of the photosensitive member as a result of contamination with, e.g., nitrogen oxides, and reduced memory of the photosensitive member resulting from ions remaining in the charging device while the electrophotographic device is out of service.

A new charging method was developed to solve the above problems, where a charging member such as roll or blade is brought into contact with the photosensitive member (this approach is hereinafter referred to as direct charging) to form a discharge explained by the Paschen's rule in a narrow space in the vicinity of the contact point. It is to minimize generation of ozone, and the related techniques are already disclosed by, e.g., Japanese Patent Application Laid-Open Nos. 57-178257, 56-104351, 58-40566, 58-139156, 58-150975, and 63-149669. Of these, the method which uses a charging roll as the charging member is more preferable for charging stability.

Direct charging generates a smaller quantity of ozone than corona discharging, conceivably because of different charging mechanisms on the photosensitive member surface, coming from different discharging regions. It is considered that the photosensitive member surface is charged in corona discharging with the ions, coming from dissociated molecules in air, in the discharging region, whereas it is charged in direct charging with a number of electrons reaching the surface by the multiplication effect of the electrons in the discharging region.

It is found, however, direct charging encounters with problems to be solved, different from those involved in corona charging.

Concretely, it is necessary to apply a voltage of at least certain threshold level to the charging member for direct charging to start, because it depends on discharge from a charging member to a member to be charged, such as photosensitive member. For example, when a charging roll is brought into contact with an OPC photosensitive member with a 25 $\mu$m thick photosensitive layer, the photosensitive member starts to increase in surface potential when a voltage of at least around 640 V is applied to the charging member, the surface potential increasing linearly with voltage at an inclination of unity thereafter. This threshold voltage is hereinafter referred to as charge-starting voltage Vth.

Therefore, in order to secure a potential Vd on the photosensitive member surface, the charging roll needs a higher DC voltage of Vd+Vth. It was difficult to keep a desired potential on the photosensitive member, because of resistance of the contacting charging member changing by external disturbances, e.g., changed environmental conditions.

In order to further uniformize charging, an AC charging method is proposed, as disclosed by Japanese Patent Application Laid-Open No. 63-149669, where an AC component having a voltage of at least twice as high as Vth between the peaks is added to the DC voltage corresponding to the desired Vd level, and the totaled voltage is applied to the contacting charging member. This is aimed at leveling the potential by the AC voltage, to significantly prevent potential on the member to be charged from external disturbances, such as environmental changes, because it tends to converge to Vd as the central voltage between the AC voltage peaks.

However, the above contacting charging device also basically depends on the mechanism of discharge from the charging member to the photosensitive member, and needs, as described above, a charging voltage higher than a potential on the photosensitive member surface. Addition of an AC voltage to uniformize charging involves new problems, such as generation of vibration and noise (hereinafter referred to as the AC charging noise) of the charging member and photosensitive member by the AC field, and deterioration or the like of the photosensitive member surface by additional discharging by the AC voltage.

It is inherently desirable to charge the photosensitive member only with DC voltage, to minimize generation of ozone. However, charging with DC voltage alone is more amenable to external disturbances, e.g., environmental changes, and contamination of the charging member to cause uneven charging.

Japanese Patent Application Laid-Open No. 2-123385 discloses a contacting transfer method, in which a toner image is produced by development on an electrostatic latent image carrier, and a medium to which the image is to be transferred is pressed to the carrier by a charged electroconductive roll, to transfer the image.

However, the above roll-aided transfer method, which dispenses with corona discharge, involves its own disadvantages, such as partial transfer failure (the so-called intermediate loose of transfer) resulting from the toner image being pressed while it is transferred from the photosensitive member to the medium because the transferring member directly comes into contact with the photosensitive member via the transferring member when it is transferred.

When the transfer toner remains on the photosensitive member after the toner image produced on the photosensitive member by development is transferred to the medium, as described above, it must be removed by the cleaning process and discarded in a spent toner container. The cleaning is effected by several methods, e.g., blade cleaning, fur brush cleaning and roller cleaning, each of which mechanically removes the residual toner by, e.g., scratching and discards it in a spent toner container. Pressing the cleaning member to the photosensitive member surface invariably causes problems, such as wear and reduced serviceability of the photosensitive member when the cleaning member is strongly pressed. The cleaning device increases size of the overall device, and bottlenecks size reduction. Moreover, it is ecologically desirable to develop a system which releases no spent toner and toner of higher transfer efficiency.

Techniques to dispense with the cleaner have been disclosed by, e.g., Japanese Patent Application Laid-Open Nos. 59-133573, 62-203182, 63-133179, 64-20587, 2- 302772, 5-2289, 5-53482, and 5-61383. These prior arts, however, do not mentioned on desired toner compositions.

The image forming method which uses development/cleaning mechanism with virtually no cleaning device is liable to suffer various problems resulting from residual transfer toner directly passing through a space between the charging member and photosensitive member, e.g., contamination of the charging member and resultant uneven resistance of the member, and uneven charging which may cause extremely uneven concentration in the halftone image. The configuration invariably involves rubbing of the photosensitive member surface by the toner and toner carrier, resulting in deterioration of durability by, e.g., deteriorated toner and toner carrier surface, and deteriorated or worn photosensitive member surface, when the device is in service for extended periods. These problems cannot be sufficiently solved by the conventional techniques, and the techniques to improve characteristics related to development and durability and, at the same time, to prevent uneven charging are increasingly in demand.

Japanese Patent Application Laid-Open No. 61-279864 discloses a toner with specified shape factors SF-1 and SF-2. This prior art, however, does not completely mentioned on transfer, and needs further improvement, because of its insufficient transfer efficiency found by trace tests.

Japanese Patent Application Laid-Open No. 63-235953 discloses a magnetic toner, whose particles are made spherical by mechanical impact. However, it also needs further improvement, because of its still insufficient transfer efficiency.

Recently, color copiers, printers, facsimiles and the like, based on electrophotography, have been increasingly in demand.

Color toners are generally non-magnetic, because of insufficient tincture of a magnetic toner containing a magnetic material. When a magnetic toner is used as a black toner and non-magnetic one as color toner for a color electrophotographic device, the non-magnetic toner needs higher optimum transfer current level than the magnetic one. The magnetic toner transferred to a medium may return back to the latent image carrier (retransfer), when the electrophotographic device operates under conditions adjusted for the non-magnetic toner. Conversely, insufficient transfer of the non-magnetic toner may result, when the optimum conditions are adjusted for the black toner.

Therefore, simultaneous use of a magnetic and non-magnetic toner for image transfer causes problems which must be solved for low-cost production of a compact, light, color electrophotographic device producing images of high resolution and precision.

For the toner containing hydrotalcites, Japanese Patent No. 2,584,306 discloses an Mg/Al-based one, aimed at removal of NOx and the like from the photosensitive member surface. It is however insufficient, e.g., in charging stability. Japanese Patent No. 2,682,331 and Japanese Patent Application Laid-Open No. 6-138697 disclose, e.g., an Mg/Al-based toner incorporated with one or two types of divalent metals (e.g., Zn), a 3- or 4-element toner containing hydrotalcite, aimed at charging stability. However, they are still insufficient in charging stability and transferability under severer conditions.

SUMMARY OF THE INVENTION

It is an object of the present invention to provide a toner free of the above problems involved in the conventional ones, and also to provide an image forming method using the same toner.

In other words, it is an object of the present invention to provide a toner excellent in transferability, little remaining on the photosensitive member and causing no intermediate loose of transfer in roll-aided transfer (or at least such a phenomenon is well-controlled), and also to provide an image forming method using the same toner.

It is another object of the present invention to provide a toner showing excellent charging stability under severe conditions, little decreasing in concentration resulting from charge-up while the device is in service and charge-down while it is out of service, and producing little image defects, such as fog, and also to provide an image forming method using the same toner.

It is still another object of the present invention to provide a toner capable of preventing the retransfer phenomenon over a wide transfer current range and showing high transfer efficiency, and also to provide an image forming method using the same toner.

It is still another object of the present invention to provide a toner causing no or well-controlled abnormal charging or image defects resulting from contamination of the member pressed to the electrostatic latent image carrier, and also to provide an image forming method using the same toner.

It is still another object of the present invention to provide a toner excellent in developability and durability to continuously produce a number of images of high resolution by a copier or printer, and also to provide an image forming method using the same toner.

It is still another object of the present invention to provide a toner excellent in transferability, little remaining on the photosensitive member and causing no charging failure in a contact charging type image forming method even in the absence of a cleaning device and capable of producing stable images for extended periods, and also to provide an image forming method using the same toner.

It is still another object of the present invention to provide a toner, comprising toner particles containing a binder resin and colorant, inorganic fine particles, and a hydrotalcite compound shown by the formula (1):

$$M1_{y1}^{2+}M2_{y2}^{2+}\ldots Mj_{yj}^{2+}L1_{x1}^{3+}L2_{x2}^{3+}\ldots Lk_{xk}^{3+}(OH)_2.(X/n)\,A^{n-}.mH_2O \quad (1)$$

wherein $0<[X=(x1+x2+\ldots+xk)]\leqq 0.5$; $Y=(y1+y2+\ldots+yj)=1-X$; j and k are each an integer of 2 or larger; $M1^{2+}$, $M2^{2+}$, . . . and $Mj^{2+}$ are divalent metallic ions different from each other; $L1^{3+}$, $L2^{3+}$ . . . and $Lk^{3+}$ are trivalent metallic ions different from each other; $A^{n-}$ is an n-valent anion; and $m\geqq 0$.

It is still another object of the present invention to provide an image forming method, comprising a charging step which charges an image carrier; latent image forming step which forms an electrostatic latent image on the charged image carrier; developing step which develops the electrostatic latent image with a toner carried by a toner carrier, to form the toner image on the image carrier; transfer step which transfers the toner image on the image carrier to a transfer medium through or not through an intermediate medium; and fixing step which fixes the toner image on the transfer medium, wherein the toner comprises toner particles containing at least a binder resin and colorant, inorganic fine particles, and a hydrotalcite compound shown by the formula (1):

$$M1_{y1}^{2+}M2_{y2}^{2+}\ldots Mj_{yj}^{2+}L1_{x1}^{3+}L2_{x2}^{3+}\ldots Lk_{xk}^{3+}(OH)_2.(X/n)\,A^{n-}.mH_2O \quad (1)$$

wherein $0<[X=(x1+x2+\ldots+xk)]\leqq 0.5$; $Y=(y1+y2+\ldots+yj)=1-X$; j and k are each an integer of 2 or larger; $M1^{2+}$, $M2^{2+}$ . . . and $Mj^{2+}$ are divalent metallic ions different from each other; $L1^{3+}$, $L2^{3+}$, . . . and $Lk^{3+}$ are trivalent metallic ions different from each other; $A^{n-}$ is an n-valent anion; and $m\geqq 0$.

DETAILED DESCRIPTION OF THE PREFERRED EMBODIMENTS

Figure 1:
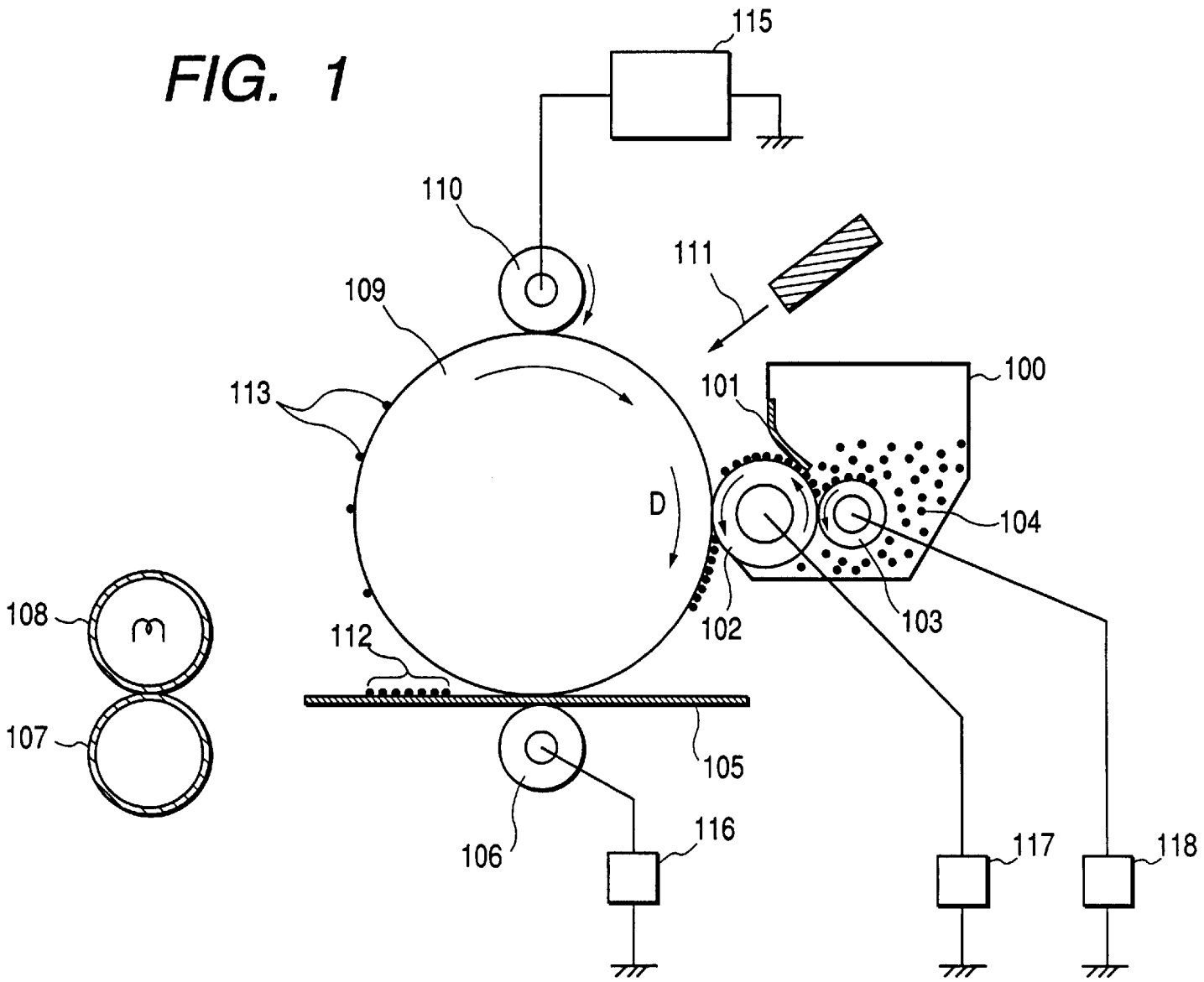
FIG. 1 shows a model of the image forming device suitably used for the present invention.

The inventors of the present invention have found that the objects of the present invention can be highly achieved by use of a toner comprising toner particles containing at least a binder resin and colorant, inorganic fine particles, and a hydrotalcite compound shown by the formula (1):

$$M1_{y1}^{2+}M2_{y2}^{2+}\ldots Mj_{yj}^{2+}L1_{x1}^{3+}L2_{x2}^{3+}\ldots Lk_{xk}^{3+}(OH)_2.(X/n)\,A^{n-}.mH_2O \quad (1)$$

wherein $0<[X=(x1+x2+\ldots+xk)]\leqq 0.5$; $Y=(y1+y2+\ldots+yj)=1-X$; j and k are each an integer of 2 or larger; $M1^{2+}$, $M2^{2+}$ . . . and $Mj^{2+}$ are divalent metallic ions different from each other; $L1^{3+}$, $L2^{3+}$, . . . and $Lk^{3+}$ are trivalent metallic ions different from each other; $A^{n-}$ is an n-valent anion; and $m\geqq 0$, i.e., the toner being a solid solution containing two or more types of divalent metals and two or more types of trivalent metals.

It is found that the above toner shows better charging stability and transferability than the one containing one type of divalent metal and one type of trivalent metals, or the one containing two or more types of divalent metals and one type of trivalent metal, although the mechanisms involved are not fully substantiated.

The hydrotalcite compound of the above structure may contain a monovalent alkali metal, or two or more types of anions.

The hydrotalcite compound is more preferably shown by the formula (2):

$$Mg_{y1}^{2+}M2_{y2}^{2+}\ldots Mj_{yj}^{2+}Al_{x1}^{3+}L2_{x2}^{3+}\ldots Lk_{xk}^{3+}(OH)_2.(X/n)\,A^{n-}.mH_2O \quad (2)$$

wherein $0<[X=(x1+x2+\ldots+xk)]\leqq 0.5$; $Y=(y1+y2+\ldots+yj)=1-X$; j and k are each an integer of 2 or larger; M2, M3, . . . and Mj are each selected from the group consisting of Zn, Ca, Ba, Ni, Sr, Cu and Fe, and are different from each other; L2, L3, . . . and Lk are each selected from the group consisting of B, Ga, Fe, Co and In, and are different from each other; $A^{n-}$ is an n-valent anion; and $m\geqq 0$.

The divalent and trivalent metals more preferably satisfy the following relationships in the formula (2):

$$y1>y2+\ldots yj,\ \text{more preferably}\ y1>10\times(y2+\ldots+yj),$$

$x1>x2+ \ldots xk$, more preferably $x1>10\times(x2+ \ldots +xk)$, and most preferably $x1>20\times(x2+ \ldots +xk)$ $0.9\leqq x1+y1<1.0$, still more preferably $0.930\leqq x1+y1\leqq 0.998$.

It is also preferable that concentrations (atomic ratios) of the divalent metals other than Mg satisfy the relationship:

$$0.001\leqq y2+ \ldots +yj\leqq 0.05,$$

and that concentrations (atomic ratios) of the trivalent metals other than Al satisfy the relationship:

$$0.0003\leqq x2+ \ldots +xk\leqq 0.02.$$

Improvement of charging stability as the object of the present invention is notably achieved when the divalent metals other than Mg and trivalent metals other than Al are present at concentrations within the above ranges. Conversely, the effect related to charging stability will be reduced when the divalent metals other than Mg and trivalent metals other than Al are present at concentrations beyond the above ranges, and environmental stability and storage stability will be reduced when they are present at concentrations below the above ranges.

It is more preferable that the hydrotalcite compound contains Ca as the divalent metal other than Mg, and B, Ge, Fe and Ga as the trivalent metals at a total atomic ratio of 0.0003 to 0.02.

Suitable $A^{n-}$ (n-valent anion) species in the hydrotalcite compound for the present invention include $CO_3^{2-}$, $OH^-$, $Cl^-$, $I^-$, $F^-$, $Br^-$, $SO_4^-$, $HCO_3^-$, $CH_3COO^-$ and $NO_3^-$, which may be used either alone or in combination.

The hydrotalcite is preferably hydrated, and more preferably m in the formulae (1) and (2) is $0.1<m<0.6$.

The hydrotalcite compound for the present invention preferably has a specific surface area of at least 1.0 $m^2/g$, more preferably 5.0 to 200 $m^2/g$.

Specific surface area was determined according to BET method by the multi-point BET method using a specific surface area analyzer Autosorb I (Yuasa Iononics) with nitrogen gas.

The hydrotalcite compound for the present invention is preferably hydrophobicized with a surface treatment agent, viewed from environmental stability. The surface treatment agents useful for the present invention include higher fatty acids, coupling agents, esters, and oil such as silicone oil. Of these, higher fatty acids, such as stearic, oleic and lauric acid, are more preferable.

The hydrotalcite compound is contained in the toner at 0.03 to 3 parts by weight, preferably 0.1 to 1.0 parts by weight, based on 100 parts by weight of the toner particles. The effects of the present invention may not be fully exhibited at below 0.03 parts by weight, whereas environmental stability may be insufficient at above 3 parts by weight.

The toner for the present invention preferably has a weight-average particle size of 3 to 10 $\mu$m, in order to precisely develop fine latent image dots for further improving image quality. The toner having a weight-average particle size of below 3 $\mu$m is undesirable as the one for the present invention, because of decreased transfer efficiency which may increase quantity of the residual toner on the photosensitive member and cause uneven images resulting from fogging or insufficient transfer. Letter and line images tend to scatter when the weight-average particle size exceeds 10 $\mu$m.

Figure 9:
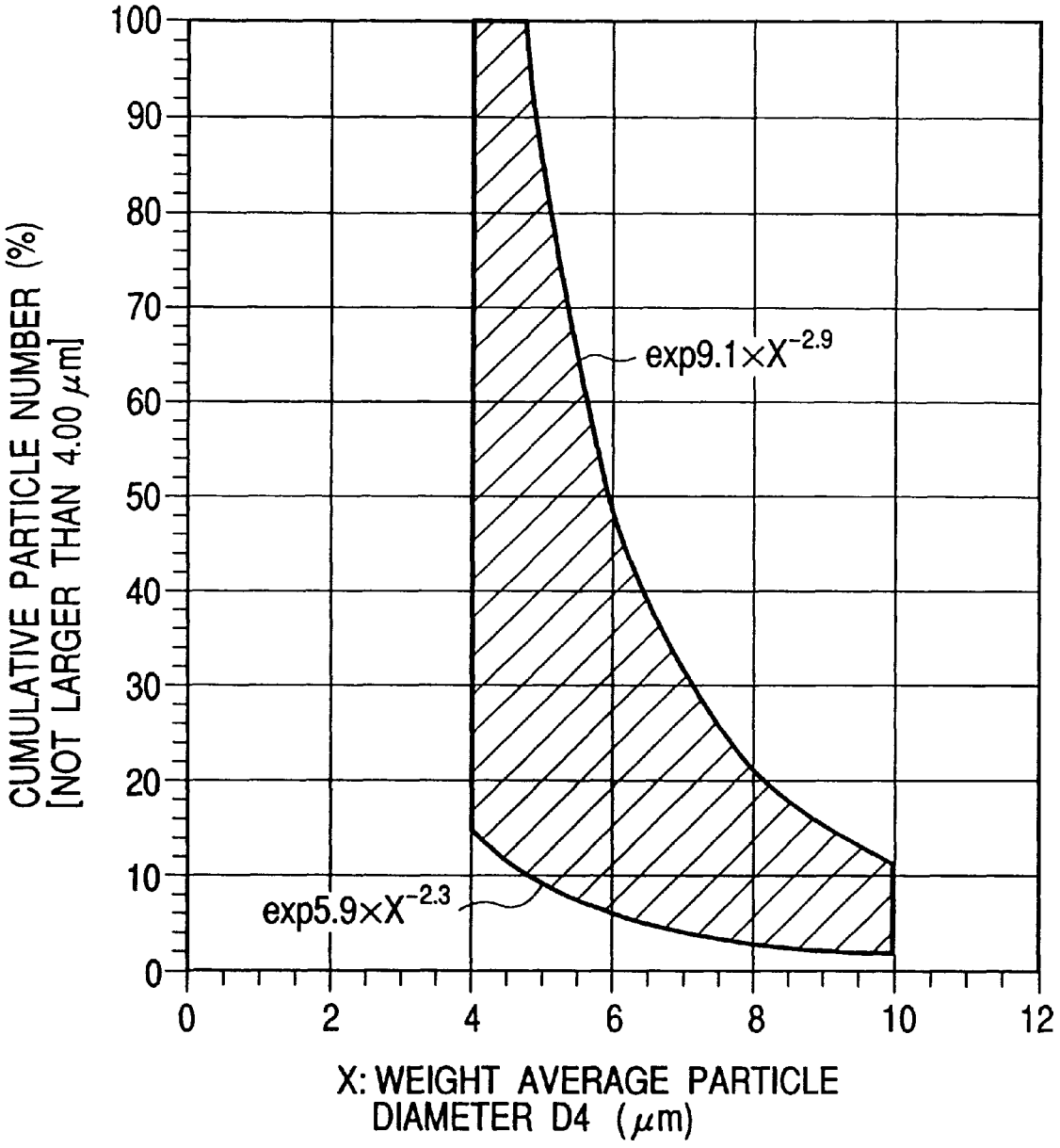
FIG. 9 shows the suitable particle size distribution range for the toner of the present invention.

It is preferable that the following relationship is satisfied (refer to FIG. 9):

$$\exp 5.9\times X^{-2.3}\leqq Y\leqq \exp 9.1\times X^{-2.9},$$

wherein X is weight-average particle size of the toner ($\mu$m) and Y is ratio (or percentage) of number of the particles having a number-based particle size of 2.00 to 4.00 $\mu$m, determined from particle number distribution, to the total number of the particles, and are in the following ranges:

X: 4.0 to 10.0 $\mu$m, and $Y<100$.

The toner of the present invention will have better environmental stability and charging stability, when it contains the hydrotalcite compound and satisfies the above conditions. The other advantages include improved dot reproducibility and uniformity of halftone images, and more efficiently controlled sleeve ghost and fogging.

Worsened sleeve ghost, in particular, will result when the Y level is below the above range, and worsened environmental stability and fogging will result when it is beyond the above range.

The toner preferably has a weight-average particle size of 4 to 8 $\mu$m, to improve image quality.

Average particle size and particle size distribution of the toner were determined using, e.g., Coulter counter TA-II or Coulter maltisizer, connected to an interface (manufactured by Japanese scientific Instrument) outputting number and volume distributions and personal computer (NEC's PC9801), with a 1% aqueous solution of first grade NaCl as the electrolytic solution. For example, ISOTON R-II (Coulter Scientific Japan) can be used. For the measurement, 100 to 150 ml of the above aqueous electrolytic solution in which 0.1 to 5 ml of a surfactant (preferably an alkyl benzene sulfonate) as the dispersant and 2 to 20 mg of the sample were suspended was dispersion-treated by a supersonic disperser for around 1 to 3 min, and measured by the coulter counter TA-II with apertures of 100 $\mu$m for the volume and number of particles having a size of 2 $\mu$m or more, to determine the volume and number distributions. These distributions were used to determine the volume-based weight-average particle size ($D_4$) and number-based length-average particle size ($D_1$).

The toner of the present invention will have more improved charging stability, transferability and durability, when it contains the hydrotalcite compound and has a shape factor SF-1, determined by a toner image analyzer, which satisfies the following relationship:

$100<SF\text{-}1\leqq 160$, preferably $100<SF\text{-}1\leqq 140$, more preferably $100<SF\text{-}1<120$.

The toner of the present invention will have still more improved transferability and charging stability, when it has a shape factor SF-2, determined by a toner image analyzer, which satisfies the following relationship:

$100<SF\text{-}2\leqq 140$, preferably $100<SF\text{-}2\leqq 130$, more preferably $100<SF\text{-}2<115$.

The shape factors SF-1 and SF-2 above can be determined by the following procedure: 100 toner images by the particles of 2 $\mu$m or more in size, magnified 1,000 times by, e.g., FE-SEM (Hitachi's S-800), are randomly sampled, and the images are transmitted via an interface to, and analyzed by, an image analyzer (e.g., Nireco K.K. Luzex III), to determine these factors by the following formulae:

$$SF-1=\frac{(MXLNG)^2}{AREA}\times\frac{\pi}{4}\times 100$$

$$SF-2=\frac{(PERI)^2}{AREA}\times\frac{1}{4\pi}\times 100$$

Figure 5:
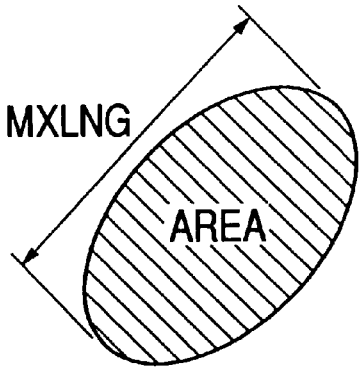
FIG. 5 shows "MXLNG" for a shape factor SF-1.
Figure 6:
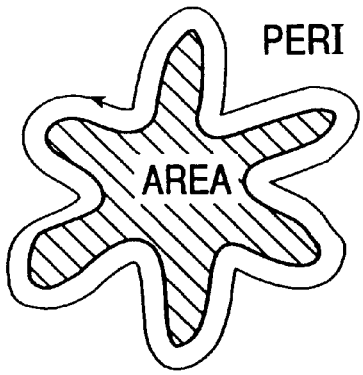
FIG. 6 shows "PERI" for a shape factor SF-2.
Figure 7:
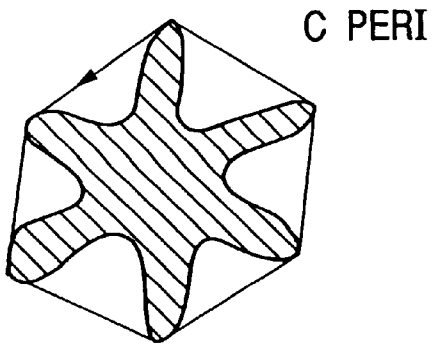
FIG. 7 shows "C PERI" for a shape factor SF-5.

The toner of the present invention will have still more improved transferability, when it has a shape factor SF-5, determined in a similar manner, which satisfies the following relationship:

$$100<SF\text{-}5\leqq 110.$$

$$SF-5=\frac{PERI}{C\ PERI}\times 100$$

wherein MXLNG is an absolute maximum length of the particle (refer to FIG. 5), PERI is a periphery of the particle (refer to FIG. 5), AREA is a projected area of the particle (refer to FIGS. 5 and 6), and C PERI is an enveloping periphery of the particle (refer to FIG. 7).

Shape factor SF-1 represents roundness, SF-2 total of roundness and roughness, and SF-5 roughness of the particle, independent of SF-1.

Controlling these factors prevents contamination of the charging member surface, when a number of images are formed, improves fusibility of the toner on the toner carrier, and further improves durability.

It is known that resolution during the development step increases as toner particle size decreases, and also that decreased particle size is accompanied by increased total surface area of the toner, and decreased powder characteristics related to fluidity and agitation, making it more difficult to uniformly charge individual particles.

However, controlling SF-1 and SF-2 within the above ranges helps charge individual fine toner particles uniformly, and increase charging speed. The hydrotalcite-containing toner accelerates charge transfer via intercalated, adsorbed water, increasing charging speed. This effect will be more noted, and highly precision images can be produced stably for extended periods by controlling SF-1 and SF-2 within the above ranges.

Any known binder resin can be used for the toner of the present invention.

For the so-called pulverizing method, in which a fused thermosetting resin is uniformly mixed and dispersed with a colorant, charge-controlling agent or the like composed of a dye or pigment, finely pulverized and classified into a desired size to produce a toner, the preferable binder resins include homopolymers of styrene or its derivative, e.g., polystyrene, poly-p-chlorostyrene and polyvinyltoluene; styrene-based copolymers, e.g., styrene-p-chlorostyrene, styrene-vinyltoluene, styrene-vinylnaphthalene, styrene-acrylic acid ester, styrene-methacrylic acid ester, styrene-methyl-α-chloromethacrylate, styrene-acrylonitrile, styrene-vinylmethyl ether, styrene-vinylethyl ether, styrene-vinylmethylketone, styrene-butadiene, styrene-isoprene, styrene-acrylonitrile-indene copolymers; and other types of resin, e.g., polyvinyl chloride, phenolic resin, modified natural phenolic resin, maleic acid resin modified with natural resin, acrylic resin, methacrylic resin, polyvinyl acetate, silicone resin, polyester resin, polyurethane, polyamide resin, furan resin, epoxy resin, xylene resin, polyvinylbutylal, terpene resin, cumarone-indene resin, and petroleum-based resin. Cross-linked styrene resin is also a preferable binder resin.

The comonomers to form the styrene-based copolymers together with styrene monomer include monocarboxylic acids with double bond and their derivatives, e.g., acrylic acid, methyl acrylate, ethyl acrylate, butyl acrylate, dodecyl acrylate, octyl acrylate, acrylic acid-2-ethylhexyl, phenyl acrylate, methacrylic acid, methyl methacrylate, ethyl methacrylate, butyl methacrylate, octyl methacrylate, acrylonitrile, methacrylonitrile and acryloamide; dicarboxylic acids with double bond and their derivatives, e.g., maleic acid, butyl maleate, methyl maleate and dimethyl maleate; vinyl esters, e.g., vinyl chloride, vinyl acetate and vinyl benzoate; ethylenic olefins, e.g., ethylene, propylene and butylene; vinyl ketones, e.g., vinyl methyl ketone and vinyl hexyl ketone; vinyl ethers, e.g., vinyl methyl ether, vinyl ethyl ether and vinyl isobutyl ether, these vinyl monomers being used either alone or in combination. The cross-linking agents useful for the present invention are typically those compounds having two or more polymerizable double bonds. These include, for example, aromatic divinyl compounds, e.g., divinyl benzene and divinyl naphthalene; carboxylic acid esters having two double bonds, e.g., ethylene glycol diacrylate, ethylene glycol dimethacrylate and 1,3-butadiol dimethacrylate; divinyl compounds, e.g., divinyl aniline, divinyl ether, divinyl sulfide and divinyl sulfonate; and compounds having three or more vinyl groups. These compounds may be used either alone or in combination.

The polymerizable monomers useful for production of the toner by polymerization include styrene-based monomers, e.g., styrene, o-, m- or p-methyl styrene and m- or p-ethyl styrene; (meth)acrylic acid esters, e.g., methyl (meth) acrylate, ethyl (meth)acrylate, propyl (meth)acrylate, butyl (meth)acrylate, octyl (meth)acrylate, dodecyl (meth) acrylate, stearyl (meth)acrylate, behenyl (meth)acrylate, 2-ethylhexyl (meth)acrylate, dimethylaminoethyl (meth) acrylate, and diethylaminoethyl (meth)acrylate; and butadiene, isoprene, cyclohexene, (meth)acrylonitrile, and amide acrylate. These compounds may be used either alone, or in combination to adequately secure, in general, a theoretical glass transition temperature (Tg) (Polymer Handbook, 2nd version, pp. 139 to 192, John Wiley & Sons) of 40 to 75° C. The mixture having a theoretical glass transition temperature below 40° C. may cause problems with respect to toner storage stability and developer durability/stability. Other problems may result when theoretical glass transition temperature exceeds 75° C.; e.g., increased fixation temperature, poor color repeatability in the case of a full-color toner, because of insufficient mixing of the color toners, and notably decreased transparency of OHP images, which are undesirable for production of high-quality images. It is possible, however, to improve characteristics related to fixation and durability in the above case by including a monomer having two or more polymerizable functional groups in the molecule, e.g., divinyl benzene, which can form adequate networks in the toner.

The monomer for producing the toner by polymerization may be incorporated with a polar polymer or copolymer having carboxylic group.

The polar polymers or copolymers useful for the present invention include those containing unsaturated carboxylic acids (e.g., acrylic and methacrylic acid) and other unsaturated dibasic acids or unsaturated dibasic acid anhydrides, and unsaturated or saturated polyesters.

The polar polymer or copolymer is contained preferably at 1 to 35 parts by weight, more preferably 5 to 20 parts by weight, based on 100 parts by weight of the polymerizable monomer.

The polymerizable monomer may become too thick for stable granulation, when the polar polymer or copolymer is contained at above 35 parts by weight.

The binder resin for the present invention preferably has an acid value of 1.0 to 40.0 mgKOH/g, more preferably 1.0 to 35.0 mgKOH/g, most preferably 2.0 to 30.0 mgKOH/g. Particularly, in producing the toner by pulverization method, combination of a resin having an acid value with the hydrotalcite compound improves environmental stability and charging stability of the toner of the present invention, and also improves its charging rise-up characteristics. Acid value above 40.0 mgKOH/g may lower its environmental stability, and that below 1.0 mgKOH/g may slightly deteriorate its charging rise-up characteristics.

Acid value of the binder resin is determined in accordance with JIS K-0070:

1) Pre-treat the sample to remove any additive other than the binder resin itself, or determine acid value and content of each component other than the binder resin beforehand. Crush the sample, and accurately measure weight of 0.5 to 2.0 g of the sample (sample weight: W (g)).

2) Transfer the sample to a 300 ml beaker, and add 150 ml of a mixed solvent of toluene/ethanol (4/1) to the beaker to dissolve the sample therein. A small quantity of acetone may be added, to accelerate dissolution.

3) Titrate the above solution with a 0.1 mol/l ethanol solution of KOH (consumption of the ethanol solution of KOH: S (ml)). Conduct the blank test (consumption of the ethanol solution of KOH: B ml).

4) Determine acid value by the following formula:

$$\text{Acid value (mgKOH/g)}=[(S-B)\times f\times 5.61]/W,$$

wherein f is factor of the 0.1 mol/l ethanol solution of KOH.

The releasing agents useful for the present invention include petroleum-based wax, e.g., paraffin wax, microcrystalline wax, petrolatum and derivatives thereof; montan wax and derivatives thereof; hydrocarbon wax produced by the Fischer-Tropsch process and derivatives thereof; polyolefin wax represented by polyethylene, and derivatives thereof; and natural wax, e.g., carnauba wax and candelilla wax, and derivatives thereof; ester wax and derivatives thereof, wherein these derivatives include oxides, block copolymers with a vinyl-based monomer and graft-modified compounds. Other releasing agents useful for the present invention include higher aliphatic alcohols, fatty acids, e.g., stearic acid and palmitic acid, and compounds thereof; acid amides, esters, ketones, hardened castor oil and derivatives thereof; and vegetable and animal wax. These compounds preferably have an endothermic peak at 60 to 120° C. in the differential thermal analysis.

Of these having an endothermic peak at 60 to 120° C. in the differential thermal analysis, particularly preferable ones for the present invention are polyolefins, hydrocarbon wax produced by the Fischer-Tropsch process, ester wax, petroleum-based wax, and higher aliphatic alcohols.

The effect of preventing "retransfer" will be further improved when one of the above compounds is used as the releasing agent.

These compounds themselves are relatively low in polarity, and considered to stabilize charging of the toner body.

The releasing agent is included preferably at 0.1 to 50% by weight based on the whole toner composition, more preferably 1 to 20% by weight, most preferably 1 to 10% by weight. The content below 0.1% by weight will result in insufficient effect of preventing offset at low temperature, whereas that above 50% by weight will result in worsened preservability of the toner or dispersibility of the other toner component, leading to worsened toner fluidity or image characteristics.

It is preferable to compound a charge-controlling agent with, or mix it with, the toner particles for the present invention. Use of a charge-controlling agent allows optimum charge controlling for a specific development system, and particularly allows to further stabilize the balance between grain size distribution and charge quantity for the present invention.

The compounds to keep the toner negatively charged include organometallic complexes and chelate compounds, e.g., metallic complexes of azo dyes or pigments, metallic complexes of acetylacetone; and metallic complexes of aromatic hydroxy-carboxylic acids and aromatic dicarboxylic acids. Other compounds useful for the present invention include aromatic hydroxy-carboxylic acids, aromatic mono- and poly-carboxylic acids, and metallic salts, anhydrides and esters thereof; and phenol derivatives, e.g., bis-phenol. Still other compounds useful for the present invention include styrene-acrylic acid copolymers, styrene-methacrylic acid copolymers, and metallic salts of azo dyes or pigments.

The compounds to keep the toner positively charged include compounds modified are as follows:

Nigrosine, an organometallic complex or the like; quaternary ammonium salts, e.g., tributylbenzylammonium-1-hydroxy-4-naphthosulfonate and tetrabutylammonium tetrafluoroborate; onium salts of phosphonium salts similar to the above, and lake pigments thereof; triphenyl methane dyes and lake pigments thereof (laking agents include phosphorus tungstate, phosphorus molybdate, phosphorus tungsten molybdate, tannic acid, lauric acid, gallic acid and ferricyanides and ferrocyanides); metallic salts of higher fatty acids; diorganotin oxides, e.g., dibutyltin oxide, dioctyltin oxide and dicyclohexyltin oxide; diorganotin borates, e.g., dibutyltin borate, dioctyltin borate, dicyclohexyltin borate; and imidazole and guanidine derivatives. These compounds may be used either alone or in combination.

The toner of the present invention can efficiently exhibit its effects, e.g., those of improving charging stability and transferability, when it is negatively charged.

The hydrotalcite compound useful for the present invention shows reversed polarity to the toner, when the latter is negatively charged. When present on the toner surface, the hydrotalcite compound uniformizes toner charge, working as the microcarrier to increase the charge when charge of the toner is decayed, and neutralizes the toner when charge of the toner is increased.

Although the hydrotalcite compound exhibits the charge-compensating effect when combined with the positively charged toner, it does more noted effects when combined with the negatively charged toner, improving toner stability further.

The charge-controlling agent is preferably in the form of fine powder, and more preferably it has a number-average particle size of 4 μm or less, most preferably 3 μm or less. It is preferable to use the charge-controlling agent at 0.1 to 20 parts by weight, more preferably 0.2 to 10 parts by weight, based on 100 parts by weight of the binder resin, when it is to be compounded with the toner.

The black colorants useful for the toner of the present invention include carbon black, magnetic particles, and yellow/magenta/cyan colorants, described below, toned for black color.

The yellow pigments useful for the present invention include the compounds represented by condensed azo compounds, isoindolinone compounds, anthraquinone compounds, complexes of azo metals, methine compounds and allyl amide compounds. More concretely, those suitably used for the present invention include C.I. pigment yellow 12, 13, 14, 15, 17, 62, 74, 83, 93, 94, 95, 97, 109, 110, 111, 120, 127, 128, 129, 147, 168, 174, 176, 180, 181 and 191.

The magenta colorants useful for the present invention include condensed azo compounds, diketopyrrolopyrrole compounds, anthraquinone, quinacridone compounds, lake compounds of basic dyes, naphthol compounds, benzimidazolone compound, thioindigo compounds and perylene compounds. More concretely, the particularly preferable colorants include C.I. pigment red 2, 3, 5, 6, 7, 23, 48:2, 48:3, 48:4, 57:1, 81:1, 144, 146, 166, 169, 177, 184, 185, 202, 206, 220, 221 and 254.

The cyan colorants useful for the present invention include copper phthalocyanine compounds and derivatives thereof, anthraquinone compounds, and lake compounds of basic dyes. More concretely, the particularly preferable colorants include C.I. pigment blue 1, 7, 15, 15:1, 15:2, 15:3, 15:4, 60, 62 and 66.

These colorants may be used either alone or in combination, and also in the form of a solid solution. The colorant to be used for the present invention is selected, based on its tint angle, color saturation, brightness, weatherproofness, OHP transparency and dispersibility in the toner. It is used at 1 to 20 parts by weight based on 100 parts by weight of the binder resin.

When a magnetic powder is used as the black colorant, it is used at 30 to 200 parts by weight based on 100 parts by weight of the binder resin, preferably 40 to 200 parts by weight, more preferably 50 to 150 parts by weight, unlike the case with the other types of colorants.

At below 30 parts by weight, it may be difficult to smoothly carry the toner in a development device which magnetically carry the toner, possibly resulting in uneven developer layer and hence uneven images. Another problem is image concentration tending to decrease, as a result of increased tribological characteristics of the developer. At above 200 parts by weight, on the other hand, fixation characteristics of the toner tends to be damaged.

The magnetic colorants useful for the present invention include those of metal oxides containing elements, such as iron, cobalt, nickel, copper, magnesium, manganese, aluminum and silicon. Of these, the preferable ones include those containing iron oxides, e.g., $Fe_3O_4$ and γ-iron oxide as the major ingredient. The magnetic colorant may contain a metallic element, such as silicon and aluminum, to control charging characteristics of the toner. These magnetic particles preferably has a specific surface area (determined by the BET method with nitrogen adsorption) of 2 to 3 $m^2/g$, more preferably 3 to 28 $m^2/g$, and a Mohs hardness of 5 to 7.

The magnetic particles may be octahedral, hexahedral, spherical, needle-like or flaky. Those of low anisotropy, such as octahedral, hexahedral, spherical and undefined shapes, are preferable for improving image concentration. The magnetic particles preferably have an average particle size of 0.05 to 1.0 μm, more preferable 0.1 to 0.6 μm and most preferably 0.1 to 0.4 μm.

Known inorganic fine particles may be included in the toner of the present invention. It is however preferable to use silica, alumina, titania or a double oxide thereof, for improving charging stability, development characteristics, fluidity and preservability of the toner. More preferable one is silica. It may be produced by the dry process, e.g., vapor-phase oxidation, from a silicon halide or alkoxide (e.g., fumed silica), or by the wet process from a silicon alkoxide or water glass. However, the one produced by the dry process is more preferable, because of lower concentration of silanol group on the surface and inside, and also lower concentration of production-caused slag, e.g., $Na_2O$ or $SO_3^{2-}$. The dry process can produce a complex oxide of silica and another metallic oxide by using a metallic halide (e.g., aluminum or titanium chloride) together with a silicon halide as the stocks. Such a complex oxide may be also included in the toner of the present invention.

The inorganic fine powder for the present invention gives good results when its specific surface area (determined by the BET method with nitrogen) is 30 $m^2/g$ or more, more preferably 50 to 400 $m^2/g$. It is used at 0.1 to 8 parts by weight based on 100 parts by weight of the toner, preferably 0.5 to 5 parts by weight, more preferably 1.0 to 3.0 parts by weight, exclusive.

It may be, and is preferably, treated with an additive as required for, e.g., hydrophobicizing or charge controlling. The additives useful for the present invention include silicone varnish, various types of modified silicone varnish, silicone oil, various types of modified silicone oil, silane coupling agent, silane coupling agent with a functional group, and other types of organosilicon and organotitanium compounds. These may be used either alone or in combination. Of these, the preferable ones are silicone oil, and those hydrophobicized with modified silicone oil.

The toner of the present invention may be incorporated with other types of fine, inorganic or organic, almost spherical particles, in addition to the above fine inorganic particles and hydrotalcite compound, to improve, e.g., cleaning-related characteristics, as one of the preferred embodiments of the present invention. These fine particles have a primary particle size above 30 nm (preferably having a specific surface area below 50 $m^2/g$), more preferably 50 nm or more (preferably having a specific surface area below 30 $m^2/g$). The preferable ones include spherical silica particles, spherical polymethylsylsesquioxane particles and spherical resin particles.

The toner of the present invention may be incorporated with one or more other types of additives, so long as the objectives of the present invention are not virtually damaged. These particulate additives include lubricants, e.g., Teflon, zinc stearate and vinilidene polyfluoride; abrasives, e.g., cerium oxide, silicon carbide, strontium titanate and calcium titanate; fluidity improvers, e.g., titanium oxide and aluminum oxide; caking-preventive agents; electroconductivity improvers, e.g., carbon black, zinc oxide and tin oxide; and small quantities of organic or inorganic fine particles of reversed polarity as the development improvers. In particular, addition of strontium titanate, calcium titanate or cerium oxide to the toner is one of the preferred embodiments of the present invention.

The toner of the present invention may be produced by known methods. For example, it may be produced by a method comprising (A) a mixing step, in which a binder resin, wax, metallic salt or complex, colorant (e.g., pigment, dye or magnetic powder), charge-controlling agent as required, and other additives are thoroughly mixed one another by a mixer, such as Henschel mixer or ball mill, (B) a dissolution step, in which the resin components in the above mixture are molten and kneaded to dissolve themselves in each other by a thermal kneader (e.g., heated roll, kneader or extruder), and then the metal compound and colorant (e.g., pigment, dye or magnetic powder) are dispersed or dissolved in the above solution, and (C) a solidification step, in which the above mixture is cooled and solidified, which are followed by a pulverization, classification and surface treatment, to produce the toner particles, which are then mixed with the fine, inorganic particles and hydrotalcite compound. The classification step may be followed by the surface treatment step, or vice versa. It is preferable to use a multiple classifier for the classification step, to improve productivity.

In the production of toner using crushing, it is preferable to effect crushing under heating using a known crusher (e.g., mechanical impact or jet type), in order to secure a sharper particle-roundness distribution. The mechanical impact may be added as an auxiliary step to the above crushing process, to have better results.

The hot water bath method in which the finely crushed (and classified as required) toner particles are dispersed in hot water, and another method in which the particles are passed in a flow of hot gas can be used. However, it is more preferable to treat the particle by mechanical impact, viewed from toner properties (e.g., charging characteristics, transferability), image quality and productivity.

The suitable mechanical impact type crushers include Kawasaki Heavy Industries' cryptron system, Turbo Kogyo's turbo mill, Hosokawa Micron's mechanofusion system and Nara Kikai Seisakusho's hybridization system, the last two systems applying mechanical impact by, e.g., compressive or frictional force, to the toner particles centrifugally pressed to the inner walls of the casing by a blade operating at a high speed.

The toner of the present invention can have a specific shape and size distribution by a disk or multi-liquid nozzle, disclosed by Japanese Patent Publication No. 56-13945, in which the molten mixture is sprayed into the air to produce the spherical toner particles; suspension polymerization as disclosed by Japanese Patent Publication No. 36-10231 and Japanese Patent Application Laid-Open Nos. 59-53856 and 59-61842, in which the toner particles are directly produced, a method which uses an aqueous organic solvent, in which the monomer is soluble but the polymer product is insoluble, to directly produce the toner particles, dispersion polymerization which uses an aqueous organic solvent, in which the monomer is soluble but the polymer product is insoluble, to directly produce the toner particles, or emulsion polymerization (represented by soap-free polymerization), in which the toner particles are directly polymerized in the presence of an aqueous, polar polymerization initiator.

More concretely, the toner of the present invention can be produced by the following polymerization method. A colorant, charge-controlling agent, polymerization initiator and other additives are uniformly dissolved or dispersed in the monomer by, e.g., homogenizer or supersonic disperser, and the mixture is then dispersed in an aqueous phase containing a dispersion stabilizer by a common agitator, homomixer, homogenizer or the like. Preferably, the droplets of the monomer composition are granulated to have a desired toner particle size under controlled conditions of agitating speed and time. Then, the particle conditions can be sustained in the presence of the dispersion stabilizer, when the system is agitated merely to prevent settlement of the particles. The polymerization is effected at 40° C. or more, generally in a range from 50 to 90° C. The polymerization system may be further heated during the latter stage of the process. The aqueous solvent may be partly removed during the latter stage of, or on completion of, the polymerization process, in order to remove the unreacted polymerizable monomer, by-products or the like, and thereby to improve durability characteristics for the image forming method of the present invention. On completion of the reaction process, the product toner particles are washed, recovered by filtration, and dried. It is preferable to use, in general, 300 to 3,000 parts by weight of water as the solvent based on 100 parts by weight of the monomer in the above method.

When the toner of the present invention is produced by polymerization, it is necessary to take into consideration polymerization-retarding effect of the colorant and its transferability into the aqueous phase. It is therefore preferable to pre-treat the colorant with a material showing no polymerization-retarding effect for surface modification to make them hydrophobic. The preferable surface-modification method for a dye-based colorant is preliminary polymerization of part of the polymerizable monomer in the presence of the dye, the colored polymer thus produced being added to the monomer system.

The polymerization initiators useful for the present invention for the polymerization in an aqueous solvent include azo-based ones, e.g., 2,2'-azobis-(2,4-dimethylvaleronitrile), 2-2'-azobisisobutyronitrile, 1-1'-azobis(cyclohexane-1-carbonitrile), 2,2'-azobis-4-methoxy-2,4-dimethylvaleronitrile, and azobisisobutyronitrile; and peroxide-based ones, e.g., benzoyl peroxide, methylethylketone peroxide, diisopropyl peroxycarbonate, cumene hydroperoxide, 2,4-dichlorobenzoyl peroxide, and lauroyl peroxide.

The polymerization initiator is used, in general, at 0.5 to 20% by weight based on the monomer, although varying depending on desired degree of polymerization. Type of the initiator slightly varies depending on polymerization method adopted, and selected for half-life temperature in 10 h as the measure. The initiators may be used either alone or in combination.

A known cross-linking agent, chain transfer agent, polymerization inhibitor or the like may be used, to control degree of polymerization.

The dispersion stabilizers useful for the present invention for the polymerization in an aqueous solvent include inorganic oxides, e.g., calcium triphosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, a magnetic material and ferrite; and organic compounds, e.g., polyvinyl alcohol, gelatin, methyl cellulose, methylhydroxypropyl cellulose, ethyl cellulose, a sodium salt of carboxymethyl cellulose and starch, which are dispersed in an aqueous phase. The dispersion stabilizer is used preferably at 0.2 to 10 parts by weight based on 100 parts by weight of the polymerizable monomer.

The commercial dispersion stabilizers can be used directly, or the above inorganic oxides may be formed by a method involving high-speed agitation in a dispersion solvent, to obtain the fine, dispersed particles of uniform size. In the case of calcium triphosphate, for example, an aqueous solution of sodium phosphate is mixed with an aqueous solution of calcium chloride with high-speed agitation, to form the dispersion stabilizer suitable for the suspension polymerization, where 0.001 to 0.1% by weight of a surfactant may be used to make the dispersion stabilizer particles finer. More concretely, a commercial nonionic, anionic or cationic surfactant may be used. The surfactants suitable for the present invention include sodium dodecyl sulfate, sodium dodecylbenzene sulfonate, sodium tetradecyl sulfate, sodium pentadecyl sulfate, sodium octyl sulfate, sodium oleate, sodium laurate, potassium stearate, and calcium oleate.

The toner of the present invention may be used as a one-component developer, or as a two-component developer after being combined with a carrier. The carriers useful for the present invention include iron powder, magnetite powder, ferrite powder, glass beads, and magnetic powder dispersed in resin. The carrier may be coated, as required, with a resin. The resins useful for this purpose include fluorine-containing resin, phenolic resin, styrene-based resin, acrylic resin, styrene/acryl copolymer, and silicone resin. These resins may be used either alone or in combination. The toner/carrier mixing ratio of 1 to 15% by weight, preferably 2 to 13% by weight, as the toner concentration in the developer generally gives good results.

The present invention efficiently exhibits its inherent effects, when the image carrier surface is mainly composed of a high-molecular-weight binder, e.g., when an inorganic image carrier of selenium or amorphous silicon is coated with a protective layer mainly composed of resin, or a function-separated type organic image carrier is coated with a surface layer, serving as the charge-transferring layer, composed of a charge-transferring material and resin, which may be further coated with a protective layer above described. Means to impart releasing capacity to the above surface layer include (1) use of a resin which itself has a low surface energy for the layer, (2) use of an additive which gives water-repellant and lipophilic capacity, and (3) dispersion of a material of high releasing capacity in the powder. The resins useful for the means (1) include those having a structure in which a fluorine-containing or silicon-containing group or the like is introduced. The additives useful for the means (2) include surfactants. The materials useful for the means (3) include compounds having a fluorine atom, e.g., powdered ethylene polytetrafluoride, vinylidene polyfluoride and carbon fluoride. Of these, ethylene polytetrafluoride is particularly suitable. The means (3) to disperse a powder of high releasing capacity, e.g., fluorine-containing resin, in the outermost layer is particularly suitable for the present invention.

It is possible to keep contact angle of 85° or more (preferably 90° or more) at the image carrier surface with water by the above means. The toner and toner carrier are less durable, and tended to be deteriorated more, when the contact angle is below 85°.

In order to include the above powder in the carrier surface area, the layer of the binder resin dispersed with the powder is provided on the surface. Or else, the powder is dispersed in the outermost layer, when the organic image carrier itself is mainly composed of the resin, dispensing with the new surface layer.

The surface layer contains the powder at 1 to 60% by weight, preferably 2 to 50% by weight based on the whole surface layer. At below 1% by weight, the effect of improving durability of the toner and toner carrier is insufficient. At above 60% by weight, other types of problems will result, e.g., lowered strength of the layer and notably decreased quantity of incident light into the image carrier.

This invention is particularly effective for the direct charging method, in which the charging means involves the charging member directly coming into contact with the image carrier. The direct charging is one of the preferred embodiments for the present invention, because it has a larger load on the surface of the image carrier than the corona discharging method or the like, in which the charging means is not directly in contact with the image carrier, and hence shows the improved effect of increasing image carrier serviceability.

One of the preferred embodiments of the image carrier for the present invention is described below.

The electroconductive substrates useful for the image carrier include metals, e.g., aluminum and stainless steel; plastics coated with aluminum alloy or indium oxide/zinc oxide alloy; paper impregnated with electroconductive partices; plastics; and plastics containing an electroconductive polymer, which are formed into cylinders or films.

The electroconductive substrate may be coated with a subbing layer for various purposes, e.g., to improve adhesion of the photosensitive layer and coating characteristics, protect the substrate, coat the defects on the substrate, improve the substrate in characteristics related to charge injection, and protect the photosensitive layer from electrical damages. The materials useful for the subbing layer include polyvinyl alcohol, poly-N-vinyl imidazole, polyethylene oxide, ethyl cellulose, methyl cellulose, nitrocellulose, ethylene/acrylic acid copolymer, polyvinyl butyral, phenolic resin, casein, polyamide, copolymerized nylon, glue, gelatin, polyurethane, and aluminum oxide. It generally has a thickness of 0.1 to 10 $\mu$m, preferably around 0.1 to 3 $\mu$m.

The materials useful for the charge-generating layer include inorganic materials capable of generating charge, e.g., an azo-based pigment, phthalocyanine-based pigment, indigo-based pigment, perylene-based pigment, polynuclear quinone-based pigment, squarylium pigment, pyrylium salt, thiopyrylium salt, triphenylmethane-based pigment, selenium and amorphous silicon, which are dispersed in an adequate binder and formed into a shape by coating or evaporation. The binder may be selected from a wide range of binding resins, e.g., polycarbonate resin, polyester resin, polyvinyl butyral resin, polystyrene resin, acrylic resin, methacrylic resin, phenolic resin, silicone resin, epoxy resin, and vinyl acetate resin. The binder is included in the charge-generating layer at 80% by weight or less, preferably 0 to 40% by weight. The charge-generating layer has a thickness of 5 $\mu$m or less, preferably 0.05 to 2 $\mu$m.

The charge-transferring layer works to transfer charge carrier it receives from the charge-generating layer in an electric field. The charge-transferring layer is formed by coating the solution in which a charge-transferring material is dissolved, together with a binder resin as required, in a solvent. It generally has a thickness of 5 to 40 $\mu$m. The materials useful for the charge-transferring layer include polynuclear aromatic compounds having biphenylene, anthracene, pyrene or phenanthrene in the main or side chain; nitrogen-containing cyclic compounds, e.g., indole, carbazole, oxadiazole and pyrazoline; and hydrazone compounds, styryl compounds, selenium, selenium/tellurium, amorphous silicon and cadmium sulfide.

The materials useful for the binder resin which disperses the charge-transferring material therein include resins, e.g., polycarbonate resin, polyester resin, polymethacrylic acid ester, polystyrene resin, acrylic resin and polyamide resin; and organic photoconductive polymers, e.g., poly-N-vinyl carbazole and polyvinyl anthracene.

The protective layer may be provided as the surface layer. The resins useful for the protective layer include polyester, polycarbonate, acrylic resin, epoxy resin and phenolic resin, which may be hardened by a hardening agent. These resins may be used either alone or in combination.

The resin for the protective layer may be dispersed with fine, electroconductive particles, e.g., those of metals or metal oxides, preferably the ultrafine particles of zinc oxide, titanium oxide, tin oxide, antimony oxide, indium oxide, bismuth oxide, titanium oxide coated with tin oxide, indium oxide coated with tin, tin oxide coated with antimony, and zirconium oxide. They may be used either alone or in combination. When the protective layer is dispersed with particles, it is generally necessary for the particles to have a size smaller than wavelength of the incident light, in order to prevent scattering of the light by the particles. It is therefore preferable that the electroconductive or insulating particles to be dispersed in the protective layer for the present invention have a particle size of 0.5 μm or less. They are contained in the protective layer at 2 to 90% by weight based on the whole protective layer, preferably 5 to 80% by weight. The protective layer preferably has a thickness of 0.1 to 10 μm, more preferably 1 to 7 μm.

The protective layer may be formed by spray coating, beam coating or dip coating of the particle-dispersed solution.

Next, the image forming method of the present invention is described concretely.

The toner of the present invention is particularly effective for the contact charging method, in which the charging means involves the charging member directly coming into contact with the image carrier (photosensitive member). The conventional toner, when remaining after the cleaning step is attached to the direct charging member in the subsequent step, causes insufficient charging and hence uneven charging on the image. The present invention leaves a smaller quantity of the residual toner than the corona discharging method in which the charging means is not directly in contact with the image carrier, preventing the toner from attaching to the charging member. It is necessary, when it is attached to the charging member, to control increase in resistance of the member. Therefore, the toner of the present invention, containing fine particle of low electrical resistance, is suitable for the contact charging method.

When a charging roll is used as the charging member, the preferable process conditions are pressure at which it is pressed to the image carrier: 5 to 500 g/cm, AC voltage: 0.5 to 5 kVpp, AC frequency: 50 to 5 kHz, and DC voltage: ±0.2 to ±5 kV.

The other charging means include a charging blade and charging brush. These contact charging means have advantages of dispensing with high voltage and controlling ozone generation.

Electroconductive rubber is a preferable material for the charging roll or blade as the charging means. It may be coated with a layer having releasing capacity. The materials useful for this layer include nylon-based resin, polyvinylidene fluoride (PVDF), polyvinylidene chloride (PVDC) and fluorinated acrylic resin.

The toner of the present invention is suitable for the one-component jumping, one-component contacting and two-component development methods.

One of the preferred development methods for which the toner of the present invention is useful is the reversal development, in which the developer is brought into contact with the photosensitive member surface. In this method, a bias of the DC or AC component is applied during the development or during the idle time before or after the development, to control the voltage at the level at which the residual toner can be recovered from the developer and photosensitive member, where the DC component is positioned at between potential at dark and bright section. In the case of the one-component developer, the toner may be supported by an elastic roll, which is coated with the toner and brought into contact with the photosensitive member surface. It is essential in this case that the toner is in contact with the photosensitive member surface. In order to simultaneously effect the development and cleaning of the photosensitive member surface by an electric field generated between the photosensitive member and elastic roll facing the member via the toner, it is necessary for the elastic roll surface or its vicinity has a potential to develop an electric field in a narrow space between the photosensitive member surface and elastic roll surface. For this purpose, the elastic rubber for the elastic roll is controlled at an intermediate resistivity to prevent conductance and thereby to keep the electric field, or the electroconductive roll is coated with a thin insulating layer. Moreover, the above object may be achieved by the configuration in which an electroconductive resin sleeve coated with an insulating material or an insulating sleeve is provided on the electroconductive roll surface on the side facing the photosensitive member surface, and an electroconductive layer on the side not facing the photosensitive member. Another configuration uses a rigid roll as the toner carrier and a flexible object, e.g., belt, as the photosensitive member. The development roll as the toner carrier preferably has a resistivity of $10^2$ to $10^9\Omega$.cm.

In the case of one-component contacting development method, the toner-carrying roll surface and photosensitive member surface may rotate in the same or reverse direction. When rotating in the same direction, the roll preferably rotates at a higher circumferential speed than the photosensitive member, otherwise image quality tends to be deteriorated. Increasing rotating speed of the roll relative to that of the photosensitive member produces the image more accurately reflecting the latent image, because of the cycles of increased quantity of the toner supplied to the development section, increased frequency of the toner detached from the latent image, and the toner scraped off the unnecessary portion whereas the necessary portion supplied with the toner. Increasing the relative rotating speed is also advantageous for recovering the toner left from the transfer step, when the development and cleaning of the photosensitive member surface are simultaneously effected, because of the anticipated effects of physically scraping off the residual toner fast attaching to the photosensitive member by the relative movement between the photosensitive member surface and section to which the toner is attached, and recovering the toner detached by an electric field.

When the jumping development method with a one-component developer is adopted, it is preferable to spread the toner over the toner carrier to a thickness smaller than the closest distance between the toner carrier and image carrier (S-D distance), and to apply an alternating electric field to the toner layer.

In the above method, the closest distance between the image and toner carriers is kept larger than thickness of the toner layer on the toner carrier by a member to restrict the thickness, where this member is preferably of an elastic material and brought into contact with the toner carrier via the toner for uniformly charging the toner.

The toner carrier for the above method preferably has a surface roughness (JIS-specified centerline average roughness, Ra) of 0.2 to 3.5 μm.

At an Ra below 0.2 μm, the toner carrier is charged excessively, resulting in insufficient developability. At an Ra above 3.5 μm, on the other hand, the toner coating layer on the toner carrier tends to be uneven, resulting in uneven toner concentration on the image. The surface roughness is more preferably in a range from 0.5 to 3.0 μm.

It is preferable to control total quantity of charge of the toner, when the toner of the present invention is used, because of its high charging capacity. Therefore, the carrier for the toner of the present invention is preferably coated with a resin layer dispersed with fine, electroconductive particles and/or a lubricant.

The materials useful for the fine electroconductive particles to be dispersed in the resin layer which covers the toner carrier surface include carbon black, graphite, and electroconductive metal oxides (e.g., electroconductive zinc oxide) and electroconductive metal compound oxides. They may be used either alone or in combination. The resins useful for the resin layer in which the electroconductive particles are to be dispersed include those based on phenol, epoxy, polyamide, polyester, polycarbonate, polyolefin, silicone, fluorine, styrene and acrylic acid.

They are preferably thermosetting or photosetting.

The contacting transfer method is preferable for the present invention.

The contacting transfer method electrostatically transfers a developed image to a medium by bringing the image carrier or intermediate medium into contact with the transfer means via the medium, at a linear contact pressure of 2.9 N/m (3 g/cm) or more, preferably 19.6 N/m (20 g/cm) or more. Contact pressure below 2.9 N/m (3 g/cm) is undesirable, because of increased tendency toward uneven movement of the medium to which image is transferred and transfer failure.

Figure 4:
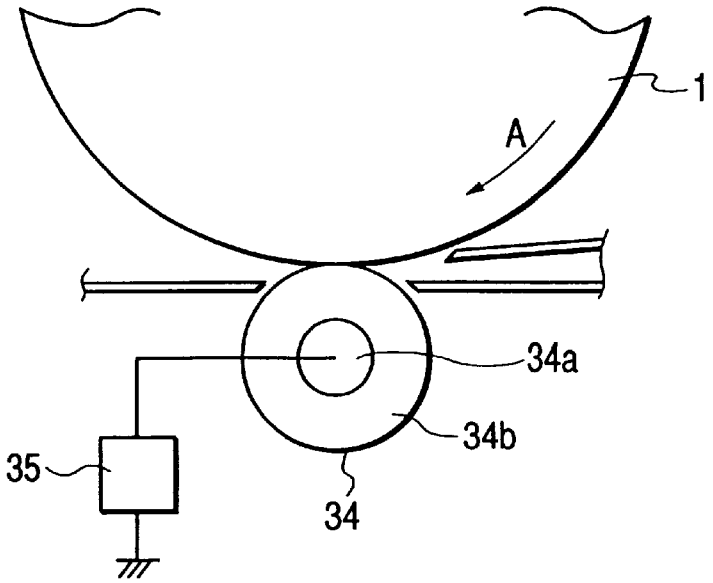
FIG. 4 shows a magnified model of the transfer section.

The transfer means for the contacting transfer method uses a transfer roll or belt. The transfer roll 34 shown in FIG. 4 is composed of at least a core metal 34*a* and electroconductive elastic layer 34*b* made of an elastic material having a volumetric resistivity of $10^6$ to $10^{10}\Omega$.cm, e.g., urethane or EPDM dispersed with an electroconductive material (e.g., carbon). A transfer bias is applied to the elastic layer from a transfer bias power source 35.

One of the preferred embodiments of the image forming method of the present invention is described by referring to FIG. 1.

In FIG. 1, 100: developing device, 109: photosensitive member, 105: medium to which the image is transferred, paper or the like, 106: transferring member, 107: pressurizing roll for fixation, 108: heated roll for fixation, and 110: primary charging member, responsible for directly charging the photosensitive member 109 after coming into contact therewith.

A bias power source 115 is connected to the primary charging member 110, for uniformly charging the surface of the photosensitive member 109.

The developing device 100 stores the toner 104, and is provided with the toner carrier 102, coming into contact with the photosensitive member 109 and rotating in the arrowed direction. It is also provided with the developing blade 101 and coating roll 103 rotating in the arrowed direction, the former controlling quantity of the toner supplied to the photosensitive member 109 and charging the photosensitive member 109, while the latter attaching the toner 104 to the toner carrier 102 and charging the toner by friction with the toner carrier 102. The development bias power source 117 is connected to the toner carrier 102. The bias power source 118 is also connected to the coating roll 103, to set voltage to the negative side from the development bias when the negatively charged toner is used, and conversely to the positive side from the development bias when the positively charged toner is used.

The transfer bias power source 116, having polarity opposite to that of the photosensitive member 109, is connected to the transfer member 106.

Contact length between the photosensitive member 109 and toner carrier 102 in the rotational direction (the so-called development nip width) is preferably 0.2 to 8.0 mm, inclusive. At below 0.2 mm, insufficient extent of development will result, causing insufficient image concentration and recovery of the toner left from the transfer step. At above 8.0 mm, on the other hand, the toner will be supplied excessively, causing lowered effect of controlling fogging and accelerating wear of the photosensitive member.

Referring to FIG. 1, the so-called elastic roll coated with an elastic layer is used as the toner carrier. The material suitably used for the elastic layer has a hardness of 20 to 65 degrees (JIS A).

The toner carrier preferably has a volumetric resistivity of around $10^3$ to $10^9\Omega$.cm. At below $10^3\Omega$.cm, overcurrent may result when the photosensitive member surface has defects, such as pinholes. At above $10^9\Omega$.cm, on the other hand, friction-caused charging may occur to charge up the toner and lower image concentration.

The toner is present on the toner carrier preferably at 0.1 to 1.5 mg/cm$^2$.

At below 0.1 mg/cm$^2$, image concentration tends to be insufficient. At above 1.5 mg/cm$^2$, on the other hand, it is difficult to uniformly charge all of the toner particles by friction, possibly lowering the effect of controlling fogging. The toner is present more preferably at 0.2 to 0.9 mg/cm$^2$.

Quantity of the toner on the toner carrier is controlled by the development blade 101, which is in contact with the toner carrier 102 via the toner layer, at a contact pressure preferably in a range from 5 to 50 g/cm. At below 5 g/cm, it will be difficult to control quantity of the toner on the toner carrier and to uniformly charge the toner by friction, possibly causing problems such as lowered effect of controlling fogging. The quantity above 50 g/cm is also undesirable, because the toner particles may be exposed to an excessive load, causing problems, such as deformation of the toner particles, and fusing of the toner particles on the development blade and toner carrier.

Referring to FIG. 1, the primary charging member 110 uniformly charges the photosensitive member 109 rotating in the arrowed direction.

An electrostatic latent image is formed on the photosensitive member 109 in accordance with information signals transmitted by light 111 from the light emitting device, and is developed into the visual image by the toner at a position at which it comes into contact with the toner carrier 102. The visual image is then transferred to the medium 105 by the transferring member 106. The transferring toner 112 passes, together with the medium 105, through the space between the heated roll 108 and pressurizing roll 107, to produce the permanent image.

The residual transferring toner 113, left on the photosensitive member 109 by the transfer step, passes through the space between the photosensitive member 109 and primary charging member 110, reaching again the development nip section, and is recovered by the toner carrier 102 back into the development device 100.

Another preferred embodiment of the image forming method of the present invention is described concretely by referring to the attached figures.

Figure 2:
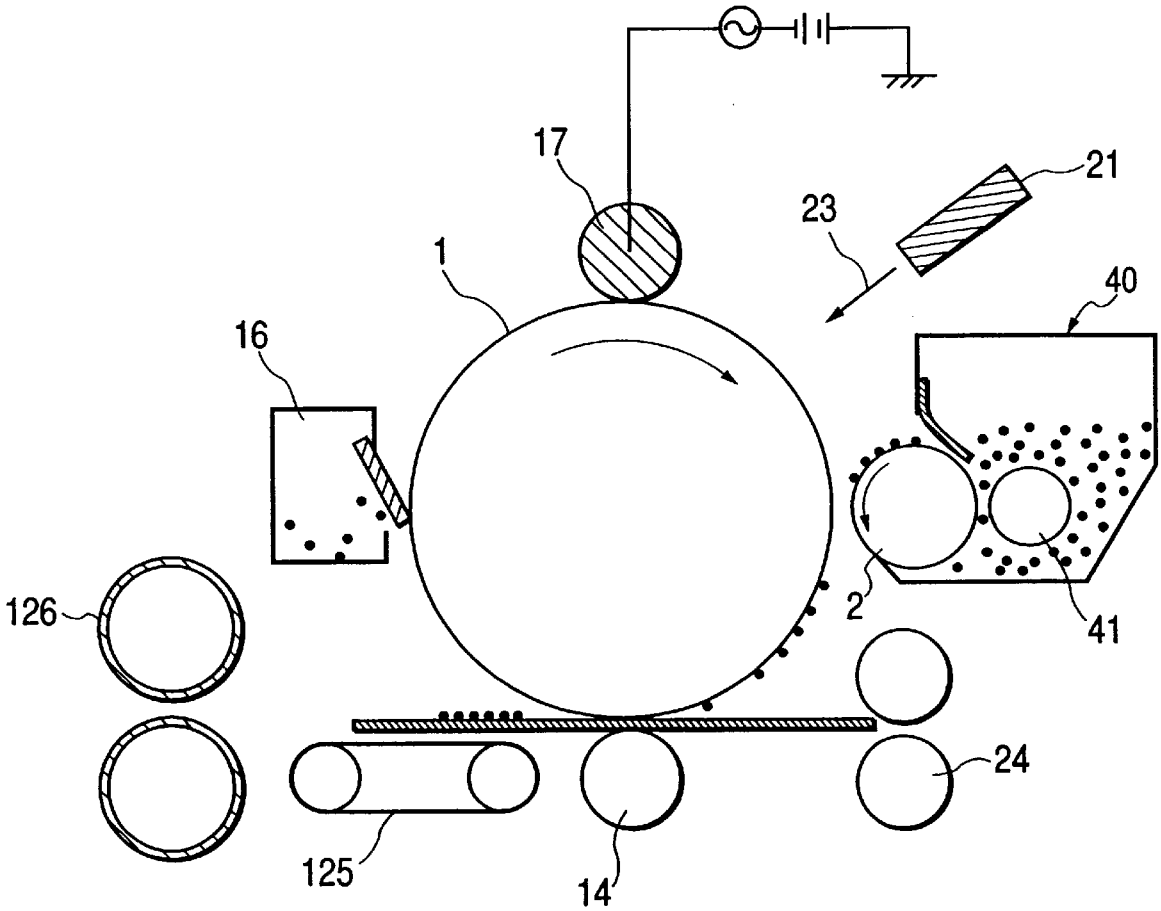
FIG. 2 shows another model of the image forming device useful for the present invention.
Figure 3:
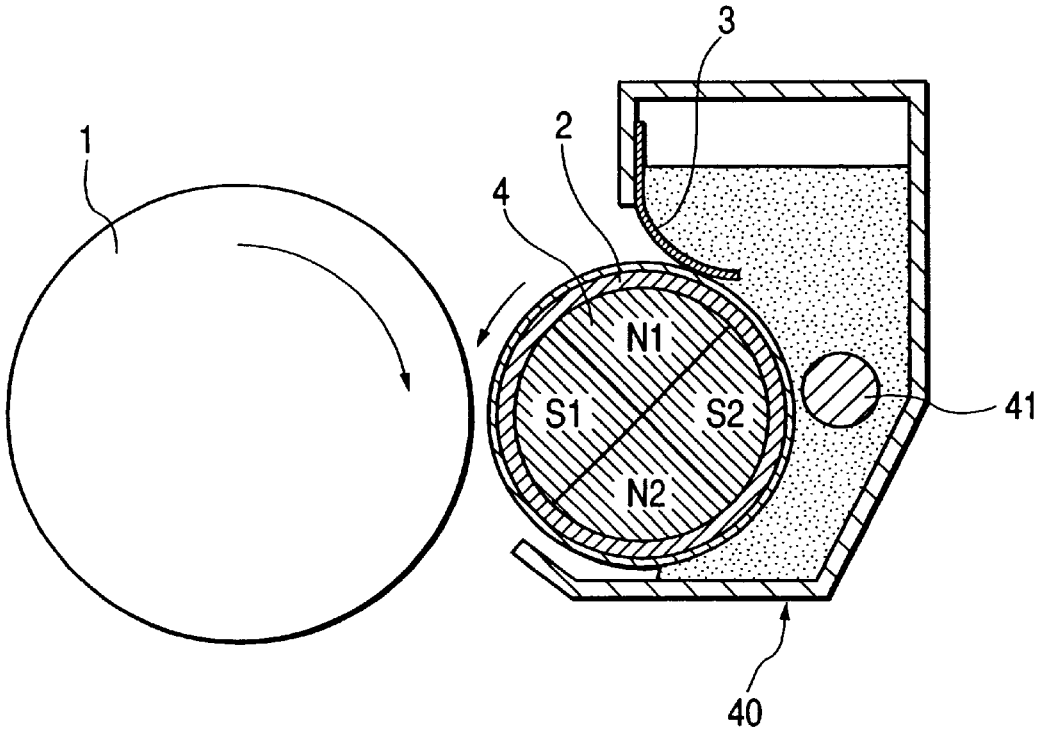
FIG. 3 outlines a magnified section of the development device.

Referring to FIG. 2, the image carrier (photosensitive member) 1 is surrounded by the primary charging member 17, development device 40, transferring means 14, cleaner 16 and resist roll 24. A bias is applied to the primary charging member 17 coming into contact with the image carrier 1, to uniformly charge the electrostatic latent image carrier 1 (primary charging). The image carrier 1 is exposed to the laser beams 23 from the laser generating device 21, to form an electrostatic latent image thereon. Referring to FIG. 3, the developing device 40, standing close to the image carrier 1, holds the toner carrier (development sleeve) 2 comprising a cylindrical substrate coated with a non-magnetic metal (e.g., aluminum or stainless steel), where the image carrier 1 and toner carrier 2 are kept separated from each other at a constant distance by a member (which is not shown). The development device 40 is equipped with a stirring rod 41 therein, and the development sleeve 2 is equipped with a magnet roll 4 therein, which is fixed concentrically with the toner carrier 2 to make it rotatable. The magnetic roll 4 has two or more magnetic poles, as shown in the FIG. 3, $S_1$, $N_1$, $S_2$ and $N_2$ being responsible for development, controlling toner quantity, toner taking-in/delivery and prevention of toner blowing, respectively. The development device 40 is also equipped with the blade 3 in contact with the toner carrier 2, which controls quantity of the magnetic toner attaching to and delivered by the toner carrier. In the development area, a development bias is applied to the space between the image carrier 1 and toner carrier 2, forcing the toner on the toner carrier 2 to fly onto the image carrier 1 in accordance with the electrostatic latent image to form the visual image.

EXAMPLES

The present invention is described by Production Examples and Examples, which by no means limit the present invention. Parts in the following compositions are part(s) by weight.

Example 1

| | |
|---|---|
| Magnetic body (average particle size: 0.22 μm, spherical) | 100 parts |
| Styrene/butyl acrylate/butyl maleate half ester copolymer (glass transition temperature Tg: 63° C.) | 100 parts |
| Iron complex of monoazo dye (negative charging controlling agent) | 2 parts |
| Low-molecular-weight polyethylene (DSC endothermic peak: 106.7° C., Mw/Mn: 1.08) | 4 parts |

The above stocks were mixed by a blender, molten and kneaded by a biaxial extruder kept at 110° C., cooled, preliminary crushed by a hammer mill, further crushed by a mechanical crusher into finer particles, and strictly classified by a multi-division classifier based on the Coanda effect, to produce the toner particles (1). The toner particles (1) had a weight-average particle size of 6.9 μm, wherein number of the particles having a size of 4.00 μm or less accounted for 21.8% of the total particle number.

Next, 100 parts of the toner particles (1) were mixed, by a mixer, with 1.2 parts of silica having a primary particle size of 12 nm (prepared by the dry process, and hydrophobicizing-treated with hexamethyl disilazane and silicone oil) and 0.3 parts of hydrotalcite A (refer to Table 1; BET specific surface area: 10 $m^2/g$, secondary particle size: 4.5 μm), to produce the toner 1. The toner 1 had a weight-average particle size of 6.9 μm, wherein number of the particles having a size of 4.00 μm or less accounted for 22% of the total particle number. Other properties are given in Table 2.

ANALYTICAL PROCEDURE

Photosensitive Member Production Example 1

Figure 8:
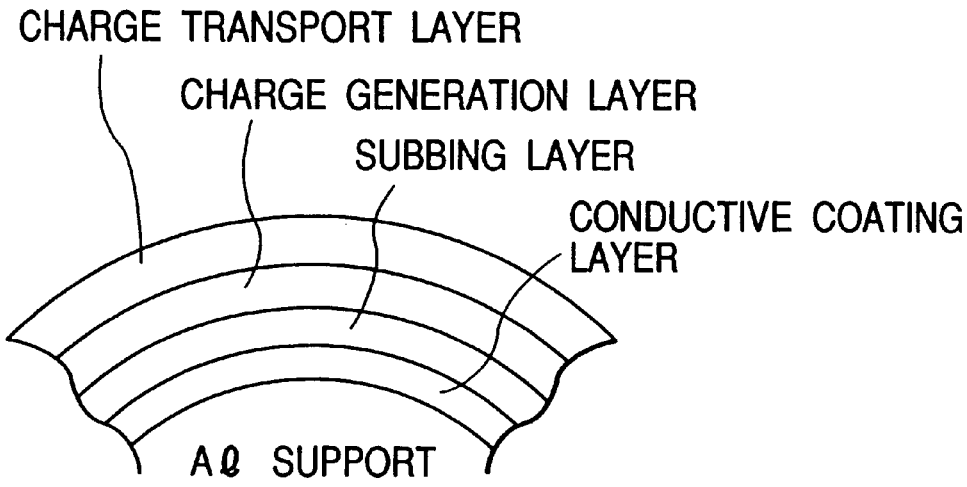
FIG. 8 shows one example of the image carrier structure.

The photosensitive member comprised A1 cylinder having a diameter 30 mm, consecutively laminated with the layers by dip coating (FIG. 8).

(1) Electroconductive coating layer: mainly composed of phenol resin dispersed with powdered tin oxide and titanium oxide. Thickness: 15 μm.

(2) Subbing layer: mainly composed of modified nylon and copolymerized nylon. Thickness: 0.6 μm.

(3) Charge-generating layer: mainly composed of butyral resin dispersed with an azo pigment having an absorption in a long wavelength region. Thickness: 0.6 μm.

(4) Charge-transferring layer: mainly composed of polycarbonate resin (molecular weight: 20,000, determined by the Ostwald viscosity method) dissolving a triphenyl amine compound capable of transferring holes (10/8 by weight), which was uniformly dispersed with powdered ethylene polytetrafluoride (particle size: 0.2 μm) at 10% by weight based on the total solid. Thickness: 25 μm. It had a contact angle of 95° with water.

Contact angle was determined by a contact angle meter (Kyowa Kaimen Kagaku, CA-X) with pure water.

The image forming device is outlined in FIG. 2.

An organic photosensitive member (OPC) drum was used as the image carrier (produced by PHOTOSENSITIVE Member Production Example 1) under the conditions of Vd: −600 V as a potential in the dark section and BL: −200 V as a potential in the light section. The photosensitive member was kept 300 μm apart from the development sleeve as the toner carrier, which comprised a mirror-polished aluminum cylinder (diameter: 20 mm) coated with an approximately 7 μm thick resin layer (JIS-specified centerline average roughness Ra: 1.3 μm) of the following composition:

| | |
|---|---|
| Phenol resin | 100 parts |
| Graphite (particle size: approximately 7 μm) | 90 parts |
| Carbon black | 10 parts |

An urethane rubber blade (thickness: 1.0 mm, free length: 10 mm) was brought into contact with the toner carrier under the conditions of development magnetic pole strength: 95 mT (950 gauss) and linear contact pressure: 7.35 N/m (7.5 g/cm).

A development bias (DC bias component Vdc: −400 V, overlapping AC vias component Vp-p: 1600 V, f: 2000 Hz) was applied. The development sleeve and photosensitive member were rotated in the same direction, the former rotating 1.1 times faster, 88 versus 80 mm/sec as circumferential speed.

The transferring roll, shown in FIG. 4 (made of ethylene-propylene rubber dispersed with electroconductive carbon, volumetric resistivity of the electroconductive elastic layer: $10^8\Omega$cm, hardness of the surface rubber: 24°, diameter: 20 mm, contact pressure: 49 N/m (50 g/cm)), was rotated at a circumferential speed of 80 mm/sec (the same speed of the photosensitive member), where transferring biases varying in a range from 2 to 20 μA were applied at intervals of 2 μA, to assess latitude of transferability. The medium onto which the image was transferred was of paper, 90 $g/m^2$.

The toner 1 gave good images, free of transfer loss in letters or lines, nor scattering on the image, at a good transfer efficiency of at least 90% over a wide bias range from 4 to 16 μA. Transferability was determined by removing the residual toner left from the transfer step using a Mylar tape and sticking it on paper, where its Macbeth concentration was subtracted from that of the blank tape alone stuck on paper.

The image forming test (2,000 sheet running test) was conducted at normal temperature and humidity (23.5° C. and 60% RH), to assess fogging and dot repeatability by the following procedures:

1) Assessment of fogging: Fogging was determined by subtracting whiteness of the medium printed with a solid white image from that of medium not printed using a reflectometer (Tokyo Denshoku). Table 3 shows maximum value of fogging in the 2,000 sheets running test:

Fogging=(whiteness before printing)−(whiteness after printing)

Figure 10:
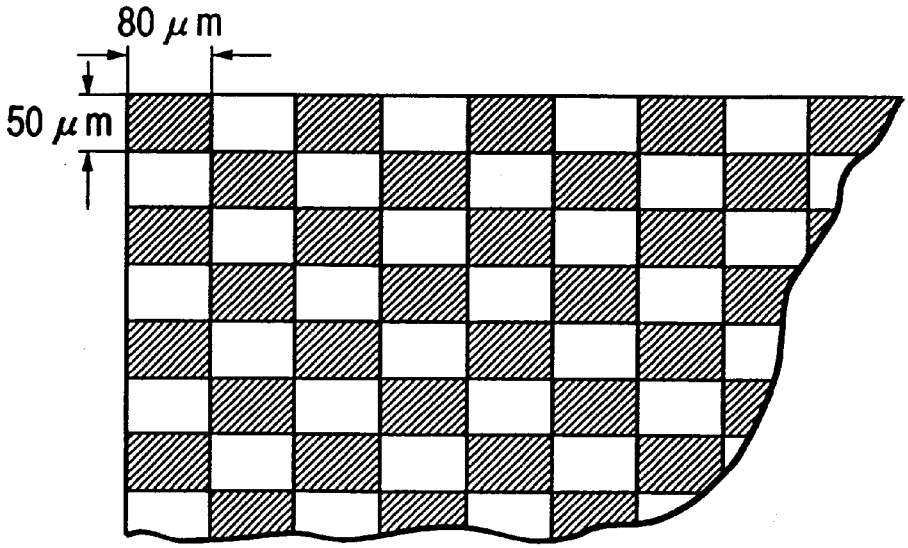
FIG. 10 shows the magnified image used for assessing dot repeatability.

2) Dot repeatability: After the 2,000 sheets running test, dot repeatability was assessed after printing out the pattern shown in FIG. 10 by the following rates:

A: Number of defective dots: 2/100 dots or less

B: Number of defective dots: 3 to 5/100 dots

C: Number of defective dots: 6 to 10/100 dots

D: Number of defective dots: 11/100 dots or more

The image-forming durability test was also conducted at high temperature and humidity (28° C. and 75% RH) by measuring quantity of charge of the toner on the development sleeve after transferring the images 1,000 times, the original image having a solid white image in the left half and solid black image in the right half.

Quantity of charge of the toner on the development sleeve was determined by the following procedure:

Measurement of Triboelectricity of the Toner

Triboelectricity of the toner was determined by the vacuum type Faraday gauge method.

The vacuum type Faraday gauge method recovers all of the toner particles in a given area on the development sleeve of a copier or printer under a vacuum using a toner recovering device, and measures weight and charge of the recovered toner, from which quantity of charge per unit weight of the toner (i.e., quantity of triboelectricity, $\mu$C/g) is determined.

The toner recovering device for the vacuum type Faraday gauge method is provided with a device for inducing the toner with air under a vacuum, to which a device for recovering the toner is connected. It is also provided with an outer and inner cylinder, the former having a suction port, the front end of which has a radius corresponding to that of the outer periphery of the development sleeve and through which the toner is induced from the development sleeve, and the latter having a cylindrical filter paper to recover the induced toner.

For recovering the toner from the development sleeve using the above toner recovering device, the development sleeve was stopped to rotate, and the toner on the sleeve was induced through the suction port of the toner recovering device, brought into contact with the development sleeve surface and slid in the longitudinal direction from one end of the sleeve to the other. The recovered toner was received by cylindrical filter of the toner recovering device.

Weight of the recovered toner was determined by the formula $W_2-W_1$ (g), where $W_2$ is the weight of the cylindrical filter holding the toner and $W_1$ is the weight of the filter itself. An electrometer (KEITHKEY, Model 617) was connected to the toner recovering device, to measure quantity of charge E ($\mu$C), from the outside, of the toner held in the electrostatically shielded inner cylinder as the cylindrical filter, and to determine quantity of friction-generated charge $Q_m$ ($\mu$C/g) by the formula:

$$Q_m=E/(W_2-W_1)$$

The assessment results are given in Table 3. The images are excellent in dot repeatability, with a small difference in quantity of charge of the toner between the solid white and black images, both for those formed during the first and second halves of the durability test, and a small difference in quantity of charge of the toner between the images formed during the first and second halves of the durability test for the solid white images, and free of concentration variation, fogging or scattering.

Example 2

The same procedure as that for Example 1 was repeated, except that copolymerization ratio of the copolymer and production conditions were changed, to prepare the toner particles (2). The toner particles (2) had a weight-average particle size of 7.1 $\mu$m, wherein number of the particles having a size of 4.00 $\mu$m or less accounted for 20.0% of the total particle number.

Next, 100 parts of the toner particles (2) were mixed, by a mixer, with 1.4 parts of silica having a primary particle size of 11 nm (prepared by the dry process, and hydrophobicizing-treated with hexamethyl disilazane and silicone oil) and 0.08 parts of hydrotalcite B (refer to Table 1; BET specific surface area: 7.5 $m^2$/g, secondary particle size: 6.5 $\mu$m), to produce the toner 2. Properties of the toner 2 are given in Table 2.

The images were formed in a manner similar to that for Example 1 using the similar devices, except that the toner 2 was used in place of the toner 1. Good results were produced, as shown in Table 3.

Example 3

The same procedure as that for Example 1 was repeated, except that copolymerization ratio of the copolymer and production conditions were changed, to prepare the toner particles (3). The toner particles (3) had a weight-average particle size of 7.5 $\mu$m, wherein number of the particles having a size of 4.00 $\mu$m or leas accounted for 15.1% of the total particle number.

Next, 100 parts of the toner particles (3) were mixed, by a mixer, with 1.4 parts of silica having a primary particle size of 11 nm (prepared by the dry process, and hydrophobicizing-treated with hexamethyl disilazane and silicone oil) and 0.7 parts of hydrotalcite C (refer to Table 1; BET specific surface area: 13 $m^2$/g, secondary particle size: 3 $\mu$m), to produce the toner 3. Properties of the toner 3 are given in Table 2.

The images were formed in a manner similar to that for Example 1 using the similar devices, except that the toner 3 was used in place of the toner 1. Good results were produced, as shown in Table 3.

Example 4

The same procedure as that for Example 1 was repeated, except that copolymerization ratio of the copolymer and production conditions were changed, to prepare the toner particles (4). The toner particles (4) had a weight-average particle size of 8.5 $\mu$m, wherein number of the particles having a size of 4.00 $\mu$m or less accounted for 11.0% of the total particle number.

Next, 100 parts of the toner particles (4) were mixed, by a mixer, with 1.4 parts of silica having a primary particle size of 11 nm (prepared by the dry process, and hydrophobicizing-treated with hexamethyl disilazane and silicone oil) and 1.2 parts of hydrotalcite D (refer to Table 1; BET specific surface area: 6 $m^2$/g, secondary particle size: 6.5 $\mu$m), to produce the toner 4. Properties of the toner 4 are given in Table 2.

The images were formed in a manner similar to that for Example 1 using the similar devices, except that the toner 4 was used in place of the toner 1. Good results were produced, as shown in Table 3.

Comparative Example 1

Styrene/butyl acrylate/divinylbenzene copolymer (glass transition temperature Tg: 65° C.) 100 parts Magnetic body 80 parts Iron complex of monoazo dye (negative charging controlling agent) 2 parts Low-molecular-weight polypropylene (DSC endothermic peak: 145° C., Mw/Mn: 8.8) 4 parts The above stocks were mixed by a blender, molten and kneaded by a biaxial extruder kept at 130° C., cooled, preliminary crushed by a hammer mill, further crushed by a jet mill into finer particles, and strictly classified by a multi-division classifier based on the Coanda effect, to produce the toner particles (5). The toner particles (5) had a weight-average particle size of 8.5 μm, wherein number of the particles having a size of 4.00 μm or less accounted for 21.2% of the total particle number.

Next, 100 parts of the toner particles (5) were mixed, by a mixer, with 1.2 parts of silica having a primary particle size of approximately 16 nm (prepared by the dry process, and hydrophobicizing-treated with 1.0 parts of hexamethyl disilazane, BET specific surface area: 100 $m^2/g$), to produce the toner 5. Properties of the toner 5 are given in Table 2.

The images were formed in a manner similar to that for Example 2 using the similar devices, except that the toner 5 was used in place of the toner 2. The image was transferred from the photosensitive member to the medium at a transfer efficiency of at least 90% only at a bias of 8 μA. A sufficient transfer latitude was not obtained. The images showed fairly large numbers of losses in letters or lines, and were significantly scattered.

Comparative Example 2

The same procedure as that for Comparative Example 1 was repeated, except that the production conditions were changed, to prepare the toner particles (6). The toner particles (6) had a weight-average particle size of 11.5 μm, wherein number of the particles having a size of 4.00 μm or less accounted for 8.5% of the total particle number.

Next, 100 parts of the toner particles (6) were mixed, by a mixer, with 1.4 parts of silica having a primary particle size of 11 nm (prepared by the dry process, and hydrophobicizing-treated with hexamethyl disilazane) and 0.7 parts of hydrotalcite E (refer to Table 1; BET specific surface area: 4.5 $m^2/g$, secondary particle size: 7 μm), to produce the toner 6. Properties of the toner 6 are given in Table 2.

The images were formed in a manner similar to that for Comparative Example 1 using the similar devices, except that the toner 6 was used in place of the toner 5. The image was transferred from the photosensitive member to the medium at a transfer efficiency of at least 90% only at a bias of 6 to 8 μA. A sufficient transfer latitude was not obtained. The images were poor, low in concentration, significantly scattered.

Comparative Example 3

The same procedure as that for Comparative Example 1 was repeated, except that the production conditions were changed, to prepare the toner particles (7). The toner particles (7) had a weight-average particle size of 10.7 μm, wherein number of the particles having a size of 4.00 μm or less accounted for 10.1% of the total particle number.

Next, 100 parts of the toner particles (7) were mixed, by a mixer, with 1.4 parts of silica having a primary particle size of 11 nm (prepared by the dry process, and hydrophobicizing-treated with hexamethyl disilazane and silicone oil) and 0.7 parts of hydrotalcite F (refer to Table 1; BET specific surface area: 2.5 $m^2/g$, secondary particle size: 13 μm), to produce the toner 7. Properties of the toner 7 are given in Table 2.

The images were formed in a manner similar to that for Comparative Example 1 using the similar devices, except that the toner 7 was used in place of the toner 5. The image was transferred from the photosensitive member to the medium at a transfer efficiency of at least 90% only at a bias of 8 μA. A sufficient transfer latitude was not obtained. The images were poor, low in concentration, significantly scattered.

Example 5

The same procedure as that for Example 1 was repeated, except that hydroxytalcite G was used in place of hydroxytalcite A, to prepare the toner 8. Properties of the toner 8 are given in Table 2.

The images were formed in a manner similar to that for Example 1 using the similar devices, except that the toner 8 was used in place of the toner 1. Good results were produced, as shown in Table 3.

Comparative Example 4

The same procedure as that for Example 1 was repeated, except that hydroxytalcite H was used in place of hydroxytalcite A, to prepare the toner 9. Properties of the toner 9 are given in Table 2.

The images were formed in a manner similar to that for Example 1 using the similar devices, except that the toner 9 was used in place of the toner 1. There was a large difference in quantity of charge of the toner between the images formed during the first and second halves of the durability test, indicating insufficient stability of charging.

Example 6

The same procedure as that for Example 1 was repeated, except that the styrene/butyl acrylate/butyl maleate half ester copolymer was replaced by a polyester resin (bisphenol A propylene oxide adduct/bisphenol A ethylene oxide adduct/fumaric acid/trimellitic acid : 2.6/1.7/3.9/1.8, Tg: 57.5° C.) and production conditions were changed, to prepare the toner particles (10). The toner particles (10) had a weight-average particle size of 9.2 μm, wherein number of the particles having a size of 4.00 μm or less accounted for 11.1% of the total particle number.

The toner particles (10) were treated in a manner similar to that for Example 1, to produce the toner 10. Properties of the toner 10 are given in Table 2.

The images were formed in a manner similar to that for Example 1 using the similar devices, except that the toner 10 was used in place of the toner 1. Good results were produced, as shown in Table 3.

Example 7

| | |
|---|---|
| Polyester resin (bisphenol A propylene oxide adduct/bisphenol A ethylene oxide adduct/terephthalic acid/trimellitic acid/dodecenylsucccinic acid: 3.4/1.6/2.4/0.6/2.0, Tg: 60° C.) | 100 parts |
| Magnetic body (average particle size: 0.22 μm, spherical) | 100 parts |
| Iron complex of monoazo dye (negative charging controlling agent) | 2 parts |
| Low-molecular-weight polyethylene (DSC endothermic peak: 106.7° C., Mw/Mn: 1.08) | 4 parts |

The above stocks were mixed by a blender, molten and kneaded by a biaxial extruder kept at 110° C., cooled, preliminary crushed by a hammer mill, further crushed by a mechanical crusher into finer particles, and strictly classified by a multi-division classifier based on the Coanda effect, to produce the toner particles (11). The toner particles (11) had a weight-average particle size of 9.2 μm, wherein number of the particles having a size of 4.00 μm or less accounted for 20.0% of the total particle number.

Next, 100 parts of the toner particles (11) were mixed, by a mixer, with 1.2 parts of silica having a primary particle size of 12 nm (prepared by the dry process, and hydrophobicizing-treated with hexamethyl disilazane and silicone oil) and 0.3 parts of hydrotalcite A (refer to Table 1; BET specific surface area: 10 $m^2/g$, secondary particle size: 4.5 μm), to produce the toner 11. The toner 11 had a weight-average particle size of 9.2 μm, wherein number of the particles having a size of 4.00 μm or less accounted for 19.0% of the total particle number. Other properties are given in Table 2.

The images were formed in a manner similar to that for Example 1 using the similar devices, except that the toner 11 was used in place of the toner 1. Generally good results were produced, although slightly inferior to those prepared by other Examples in dot repeatability, as shown in Table 3.

Example 8

The same procedure as that for Example 1 was repeated, except that the toner 1 was further incorporated with 4.0 parts of strontium titanate, to prepare the toner 12. Properties of the toner 12 are given in Table 2.

The images were formed in a manner similar to that for Example 1 using the similar devices, except that the toner 12 was used in place of the toner 1. Good results were produced, as shown in Table 3.

Example 9

Ion-exchanged water (710 g) was put in a 2 L four-necked flask, to which 450 g of 0.1 M aqueous solution of $Na_3PO_4$ was added. The mixture was heated to 60° C., and agitated at 12,000 rpm by a high-speed agitator (Tokushu Kika Kogyo, TK homomixer), to which 68 g of 1.0 M aqueous solution of $CaCl_2$ was added slowly, to prepare the aqueous solvent containing fine, sparingly water-soluble dispersion stabilizer.

A solute of the following composition was prepared:

| | | |
|---|---|---|
| (Monomer) | Styrene | 155 parts |
| | N-butyl acrylate | 45 parts |
| (Colorant) | Carbon black | 12 parts |
| (Charge-controlling agent) | A compound of monoazo pigment with iron | 4 parts |
| (Releasing agent) | Ester wax (softening point: 75° C.) | 20 parts |

Of the above components, only the colorant, compound of monoazo pigment with iron and styrene were mixed with each other by an attritor (Mitui Kinzoku), to prepare the master batch of carbon black. This master batch was molten together with the other components at 60° C., to prepare the homogeneous monomer mixture. It was then incorporated with 8 parts of 2,2'-azobis(2,4-dimethylvaleronitrile) as the initiator, while it was kept at 60° C. to dissolve it, to prepare the monomer composition.

The monomer composition was added to the aqueous solvent, prepared in the 2 L flask of the homomixer. The mixture was agitated at 60° C. in a nitrogen atmosphere at 10,000 rpm by the TK homomixer for 20 min, and the monomer composition was granulated. Then, they were reacted with each other at 60° C. for 6 hr with stirring by a paddle agitating blade, and polymerized at 80° C. for 10 hr.

On completion of the polymerization process, the effluent was cooled, to which hydrochloric acid was added to dissolve the sparingly water-soluble dispersion stabilizer, filtered, washed with water and dried, to prepare the black polymerized particles (1), having a weight-average particle size of 7.1 μm, wherein number of the particles having a size of 4.00 μm or less accounted for 20% of the total particle number. Properties of the particles (1) are given in Table 4.

Next, 100 parts of the black polymerized particles (1) were mixed with 1.0 part of silica (originally having a BET specific surface area of 200 $m^2/g$, and surface-treated to be hydrophobic with a silane coupling agent and silicone oil to have a BET specific surface area of 120 $m^2/g$) and 0.3 part of hydrotalcite A, to produce the toner 13. Properties of the toner 13 are given in Table 5.

A 600 dpi laser beam printer (Canon, LBP-860) was used as the electrophotographic device, which was operated at 47 mm/s as a process speed.

The cleaning rubber blade of the process cartridge in the above device was removed, to allow the device to operate in the direct charging mode in which the toner was directly charged by the rubber roll with which it was in contact. A DC component of voltage (−1200 V) was applied.

Next, the development section of the process cartridge was modified, to replace the stainless sleeve as the toner supplier by a rubber roll of medium resistivity, made of silicone rubber dispersed with carbon black (diameter: 16 mm, hardness: ASKER C 45°, resistivity: $10^5$ Ω·cm) as the toner carrier coming into contact with the photosensitive member. The development nip width was set at around 2 mm. The toner carrier and photosensitive member were rotated in the same direction, the former rotating 1.3 times faster.

The photosensitive member comprised A1 cylinder having a diameter 30 mm and a length of 254 mm, consecutively laminated with the layers.

(1) Electroconductive coating layer: mainly composed of phenol resin dispersed with powdered tin oxide and titanium oxide. Thickness: 15 μm.

(2) Subbing layer: mainly composed of modified nylon and copolymerized nylon. Thickness: 0.6 μm.

(3) Charge-generating layer: mainly composed of butyral resin dispersed with a titanyl phthalocyanine pigment having an absorption in a long wavelength region. Thickness: 0.6 μm.

(4) Charge-transferring layer: mainly composed of polycarbonate resin (molecular weight: 20,000, determined by the Ostwald viscosity method) dissolving a triphenyl amine compound capable of transferring holes (10/8 by weight). Thickness: 20 μm.

A coating roll of foamed urethane rubber, serving as the means to coat the toner carrier with the toner, was provided in the developing device, and brought into contact with the toner carrier. A voltage of approximately 550 V was applied to the roll. A resin-coated stainless steel blade was also provided, to control the toner layer on the toner carrier, and brought into contact with the toner carrier at a linear contact pressure of approximately 20 g/cm. Only a DC voltage of −450 V was applied during the development step.

The electrophotographic device was modified and its process conditions were set, as described below, to match the modified process cartrdge.

The modified device uniformly charged the image carrier by the roll type charging device to which a DC voltage was applied. The image portion was exposed to laser beams to form the latent image, which was visualized by the toner, and the toner image was then transferred to the transfer medium by the roll to which a voltage was applied.

The photosensitive member was set at charging potentials of −600 V in the dark section and −150 V in the light section. The transfer medium was of paper, 75 g/m$^2$.

The durability test was conducted using the image forming device with the toner 13 under high temperature and humidity (30° C. and 80% RH).

For durability assessment, images were formed on 1,500 copies, where the image portion accounted for 5% of the total area. Durability was assessed by number of copies showing uneven charging on the halftone images resulting from contamination of the charging member, and solid black image concentration of the defective copies, determined by a reflection concentration analyzer (Macbeth). A total of 1,500 copies were produced continuously, when there was no defect detected. A toner was considered to be more durable, when the defect-free images were transferred onto a larger number of copies, and the image showed a higher concentration when a defect was detected. A total of 3,000 copies were produced, after the durability test producing 1,500 copies was completed, in order to observe uneven charging.

Quantity of the toner remaining on the roll was measured, after the durability test producing 1,500 copies was completed. Contamination of the charging roll was assessed by quantity of the toner remaining in the unit area (mg/cm$^2$).

Transferability was determined by removing the residual toner left from the transfer step using a Mylar tape and sticking it on paper, where its concentration determined by a Macbeth analyzer was subtracted from that of the blank tape alone stuck on paper, after a total of 50 copies of solid black images, each accounting for 5% of the total area, were produced. A smaller quantity of the residual toner means higher transferability.

Resistance to fogging was determined by removing the residual toner left from the transfer step using a Mylar tape and sticking it on paper, where its concentration determined by a Macbeth analyzer was subtracted from that of the blank tape alone stuck on paper, after a total of 50 copies of solid white images, each accounting for 5% of the total area, were produced. A smaller quantity of the residual toner means higher resistance to fogging.

Resolution was determined by repeatability of a small, isolated dot at 600 dpi, at which repeatability is likely deteriorated because of a latent image field tending to close the electrical field. An isolated dot image was printed out as the sample, after a total of 50 copies of images, each accounting for 5% of the total area, were produced. Resolution was assessed by the following rates:

A: Number of defective dots: 5/100 dots or less

B: Number of defective dots: 6 to 10/100 dots

C: Number of defective dots: 11 to 20/100 dots

D: Number of defective dots: above 20/100 dots

The image-forming test was also conducted at normal temperature and humidity (23.5° C. and 60% RH), to assess image concentration and transferability.

Image concentration was determined by a reflection concentration analyzer (Macbeth) for the solid black image printed out after a total of 50 copies of images, each accounting for 5% of the total area, were produced, to measure capacity of forming the solid black image.

Transferability was assessed by the test similar to that conducted at high temperature and humidity.

It is found by the above tests and assessment under the above conditions that the toner 13 gives excellent initial image forming characteristics and also shows excellent durability. The results are given in Table 6.

Example 10

The same procedure as that for Example 9 was repeated, except that the solute of the following composition was used, to prepare the black polymerized particles (2):

| | | |
|---|---|---|
| (Monomer) | Styrene | 160 parts |
| | N-butyl acrylate | 40 parts |
| (Colorant) | Carbon black | 12 parts |
| (Charge-controlling agent) | A compound of monoazo pigment with iron | 4 parts |
| (Releasing agent) | Low-density polyethylene wax (softening point: 115° C.) | 20 parts |

The black polymerized particles (2) had a weight-average particle size of 7.0 μm, wherein number of the particles having a size of 4.00 μm or less accounted for 28% of the total particle number. Properties of the black polymerized (2) are given in Table 4.

The same procedure as that for Example 9 was repeated, except that the black polymerized particles (2) were used in place of the black polymerized particles (1), to prepare the toner 14. Properties of the toner 14 are given in Table 5.

The images were formed in a manner similar to that for Example 9 using the similar devices, except that the toner 14 was used in place of the toner 13. The results are given in Table 6.

Example 11

The same procedure as that for Example 9 was repeated, except that the releasing agent was replaced by 100 g of ester wax having a softening temperature of 75° C., to prepare the black polymerized particles (3). The black polymerized particles (3) had a weight-average particle size of 7.2 μm, wherein number of the particles having a size of 4.00 μm or less accounted for 22% of the total particle number. The same procedure as that for Example 9 was repeated, except that the black polymerized particles (3) were used in place of the black polymerized particles (1), to prepare the toner 15. The images were formed in a manner similar to that for Example 9 using the similar devices, except that the toner 15 was used in place of the toner 13.

Example 12

The same procedure as that for Example 9 was repeated, except that the releasing agent was replaced by low-molecular-weight ethylene-propylene wax having a softening temperature of 143° C., to prepare the black polymerized particles (4). The black polymerized particles (4) had a weight-average particle size of 7.5 μm, wherein number of the particles having a size of 4.00 μm or less accounted for 22% of the total particle number. The same procedure as that for Example 9 was repeated, except that the black polymerized particles (4) were used in place of the black polymerized particles (1), to prepare the toner 16. The images were formed in a manner similar to that for Example 9 using the similar devices, except that the toner 16 was used in place of the toner 13.

Example 13

The same procedure as that for Example 9 was repeated, except that quantity of the sparingly water-soluble dispersion stabilizer was adjusted, to prepare the black polymerized particles (5). The black polymerized particles (5) had a weight-average particle size of 9.2 μm, wherein number of the particles having a size of 4.00 μm or less accounted for 10% of the total particle number. The same procedure as that for Example 9 was repeated, except that the black polymerized particles (5) were used in place of the black polymerized particles (1), to prepare the toner 17. The images were formed in a manner similar to that for Example 9 using the similar devices, except that the toner 17 was used in place of the toner 13.

Example 14

Ion-exchanged water (710 g) was put in a 2 L four-necked flask, to which 450 g of 0.1 M aqueous solution of $Na_3PO_4$ was added. The mixture was heated to 60° C., and agitated at 12,000 rpm by a high-speed agitator (Tokushu Kika Kogyo, TK homomixer), to which 68 g of 1.0 M aqueous solution of $CaCl_2$ was added slowly, to prepare the aqueous solvent containing fine, sparingly water-soluble dispersion stabilizer.

A solute of the following composition was prepared:

| | | |
|---|---|---|
| (Monomer) | Styrene | 155 parts |
| | N-butyl acrylate | 45 parts |
| (Polar resin) | Polyester produced from bisphenol A propylene oxide adduct and terephthalic acid (Mw: 12,000, Mn: 9,000, acid value: 6 mg KOH/g) | 5 parts |
| (Colorant) | Carbon black | 12 parts |
| (Charge-controlling agent) | A compound of monoazo pigment with iron | 4 parts |
| (Releasing agent) | Ester wax (softening point: 75° C.) | 20 parts |

Of the above components, only the colorant, compound of monoazo pigment with iron and styrene were mixed with each other by an attritor (Mitui Kinzoku), to prepare the master batch of carbon black. This master batch was molten together with the other components at 60° C., to prepare the homogeneous monomer mixture. It was then incorporated with 8 parts of 2,2'-azobis(2,4-dimethylvaleronitrile) as the initiator, while it was kept at 60° C. to dissolve it, to prepare the monomer composition.

The monomer composition was added to the aqueous solvent, prepared in the 2 L flask of the homomixer. The mixture was agitated at 60° C. in a nitrogen atmosphere by the TK homomixer at 10,000 rpm for 20 min, and the monomer composition was granulated. Then, they were reacted with each other at 60° C. for 6 hr with stirring by a paddle agitating blade, and polymerized at 80° C. for 10 hr.

On completion of the polymerization process, the effluent was cooled, to which hydrochloric acid was added to dissolve the sparingly water-soluble dispersion stabilizer, filtered, washed with water and dried, to prepare the black, polymerized particles (6), having a weight-average particle size of 6.7 μm, wherein number of the particles having a size of 4.00 μm or less accounted for 25% of the total particle number. The same procedure as that for Example 9 was repeated, except that the black polymerized particles (6) were used in place of the black polymerized particles (1), to prepare the toner 18. Properties of these particles are given in Tables 4 and 5.

The images were formed in a manner similar to that for Example 9 using the similar devices, except that the toner 18 was used in place of the toner 13. The results are given in Table 6.

Example 15

The same procedure as that for Example 14 was repeated, except that the polar resin was replaced by styrene/n-butyl acrylate/acrylic acid copolymer (Mw: 10,000, Mn: 7,000, acid value: 27 mgKOH/g), to prepare the black polymerized particles (7). The black polymerized particles (7) had a weight-average particle size of 5.5 μm, wherein number of the particles having a size of 4.00 μm or less accounted for 45% of the total particle number. The same procedure as that for Example 14 was repeated, except that the black polymerized particles (7) were used in place of the black polymerized particles (6), to prepare the toner 19. The images were formed in a manner similar to that for Example 14 using the similar devices, except that the toner 19 was used in place of the toner 18.

Examples 16 to 19

The same procedure as that for Example 9 was repeated, except that hydrotalcite A to be incorporated in the toner was replaced by hydrotalcite B, C, D and G, respectively, to prepare the toners 20 to 23. The images were formed in a manner similar to that for Example 9 using the similar devices, except that the toner was changed for each of Examples 16 to 19. Properties of the toners 20 to 23 and image forming results are given in Tables 5 and 6.

Comparative Example 5

The same procedure as that for Example 9 was repeated, except that hydrotalcite A was not used, to prepare the toner 24. The images were formed in a manner similar to that for Example 9 using the similar devices, except that the toner was changed. Properties of the toner 24 and image forming results are given in Tables 5 and 6.

Comparative Examples 6 and 7

The same procedure as that for Example 9 was repeated, except that hydrotalcite A was replaced by hydrotalcite E and H, to prepare the toners 25 and 26. The images were formed in a manner similar to that for Example 9 using the similar devices, except that the toner was changed. Properties of the toners 25 and 26, and image forming results are given in Tables 5 and 6.

Example 20

The same procedure as that for Example 9 was repeated, except that addition rates of the hydrophobic silica and hydrotalcite A were changed to 1.5 and 0.5 wt. %, to prepare the toner 27. The images were formed in a manner similar to that for Example 9 using the similar devices, except that the toner was changed. Properties of the toner 27, and image forming results are given in Tables 5 and 6.

Example 21

The images were formed in a manner similar to that for Example 9 using the similar devices, except that the cleaning step was effected without removing the cleaning blade from the process cartridge of the image forming device. The good results, similar to those by Example 9, were obtained. Quantity of the residual toner on the charging roll was 0.01 $mg/cm^2$, which was smaller than that observed in Example 9.

Example 22

| | | |
|---|---|---|
| (Monomer) | Styrene/butyl acrylate copolymer (copolymerization ratio: 80/20) | 100 parts |
| (Colorant) | Carbon black | 5 parts |
| (Charge-controlling agent) | A compound of monoazo pigment with iron | 4 parts |
| (Releasing agent) | Low-molecular-weight polyethylene wax (softening point: 115° C.) | 5 parts |

The above stocks were mixed beforehand, molten and kneaded by a biaxial extruder kept at 120° C., cooled, preliminary crushed by a hammer mill into particles passing through a 1 mm mesh. These particles were further crushed by an impact type crusher with jet flow into the finer particles, and classified by an air classifier, to produce the black pulverized particles (1). The black pulverized particles (1) had a weight-average particle size of 9.8 μm, wherein number of the particles having a size of 4.00 μm or less accounted for 21% of the total particle number. Properties of the particles are given in Table 4.

The same procedure as that for Example 9 was repeated, except that the black pulverized particles (1) were used in place of the black polymerized particles (1), to prepare the toner 28. The images were formed in a manner similar to that for Example 21 using the similar devices, except that the toner 28 was used. Properties of the toner 28 and image forming results are given in Tables 7 and 8.

Example 23

The black pulverized particles (1), prepared by Example 22, were added to an aqueous solution containing a surfactant, and were treated at 75° C. for 2 h with stirring at a high speed into spheres. The effluent was filtered, washed with water and dried, to produce the black pulverized particles (2). The black pulverized particles (2) had a weight-average particle size of 9.9 μm, wherein number of the particles having a size of 4.00 μm or less accounted for 17% of the total particle number.

The same procedure as that for Example 9 was repeated, except that the black pulverized particles (2) were used in place of the black pulverized particles (1), to prepare the toner 29. The images were formed in a manner similar to that for Example 21 using the similar devices, except that the toner 29 was used. Properties of the toner 29 and image forming results are given in Tables 7 and 8.

Comparative Example 8

The same procedure as that for Example 22 was repeated except that hydrotalcite A was replaced by hydrotalcite F, to prepare the toners 30. The images were formed in a manner similar to that for Example 21 using the similar devices, except that the toner was changed. Properties of the toner 30, and image forming results are given in Tables 7 and 8.

Example 24

The toner 13 was mixed with a ferrite carrier (average particle size: 46 μm) coated with silicone resin (0.5 wt.parts per 100 wt.parts of the base carrier) to prepare the two-component developer which contained the toner at 5%. The durability test was conducted for the developer using an electrophotographic copier (Canon, CLC-700) with a corona charging device, which was modified to remove the cleaning unit, at 23° C. and 60% RH, where a total of 10,000 copies were produced for the original monochromic image, accounting for 20% of the total area.

The good results were obtained, showing a small variation in charge quantity during the test. The images of high resolution were stably produced, showing a small variation in copied image concentration, and no uneven charging or fogging.

TABLE 1

Toner compositions and properties

| | | Hydro-talcite | Addition rate of hydrotalcite (wt. parts) | Finer inorganic powder | Addition rate of fine inorganic powder (wt. parts) | Addition rate of magnetic member (wt. parts) | Toner resin acid value (mgKOH/g) | Toner weight-average particle size (μm) | Number percentage of the particles having a size of 2.00 to 4.00 μm |
|---|---|---|---|---|---|---|---|---|---|
| Example 1 | Toner 1 | A | 0.3 | Silica hydrophobicizing-treated with hexamethyl disilazane and silicone oil | 1.2 | 100 | 17 | 6.9 | 22.0 |
| Example 2 | Toner 2 | B | 0.08 | Silica hydrophobicizing-treated with hexamethyl disilazane and silicone oil | 1.4 | 100 | 10 | 7.1 | 20.0 |
| Example 3 | Toner 3 | C | 0.7 | Silica hydrophobicizing-treated with hexamethyl disilazane and silicone oil | 1.4 | 100 | 5 | 7.5 | 15.1 |
| Example 4 | Toner 4 | D | 1.2 | Silica hydrophobicizing-treated with hexamethyl disilazane and silicone oil | 1.4 | 60 | 1.5 | 8.5 | 11.0 |
| Comparative Example 1 | Toner 5 | — | — | Silica hydrophobicizing-treated with hexamethyl disilazane | 1.2 | 60 | 0 | 8.5 | 21.2 |
| Comparative Example 2 | Toner 6 | E | 0.7 | Silica hydrophobicizing-treated with hexamethyl disilazane | 1.2 | 50 | 0 | 11.5 | 8.5 |
| Comparative Example 3 | Toner 7 | F | 0.7 | Silica hydrophobicizing-treated with hexamethyl disilazane | 1.2 | 50 | 0 | 10.7 | 10.1 |
| Example 5 | Toner 8 | G | 0.3 | Silica hydrophobicizing-treated with hexamethyl disilazane and silicone oil | 1.2 | 100 | 17 | 6.9 | 22.1 |

TABLE 1-continued

| | | Toner compositions and properties | | | | | | | |
|---|---|---|---|---|---|---|---|---|---|
| | | Hydro-talcite | Addition rate of hydrotalcite (wt. parts) | Finer inorganic powder | Addition rate of fine inorganic powder (wt. parts) | Addition rate of magnetic member (wt. parts) | Toner resin acid value (mgKOH/g) | Toner weight-average particle size ($\mu$m) | Number percentage of the particles having a size of 2.00 to 4.00 $\mu$m |
| Comparative Example 4 | Toner 9 | H | 0.3 | Silica hydrophobicizing-treated with hexamethyl disilazane and silicone oil | 1.2 | 100 | 17 | 6.9 | 22.0 |
| Example 6 | Toner 10 | A | 0.3 | Silica hydrophobicizing-treated with hexamethyl disilazane and silicone oil | 1.2 | 100 | 42 | 9.2 | 11.1 |
| Example 7 | Toner 11 | A | 0.3 | Silica hydrophobicizing-treated with hexamethyl disilazane and silicone oil | 1.2 | 100 | 32.5 | 9.2 | 19.0 |
| Example 8 | Toner 12 | A | 0.3 | Silica hydrophobicizing-treated with hexamethyl disilazand and silicone oil | 1.2 | 100 | 17 | 6.9 | 22.1 |
| | | | | strontium titanate | 4.0 | | | | |

TABLE 2

| | Hydrotalcite composition | | | | | | | | | | | | | |
|---|---|---|---|---|---|---|---|---|---|---|---|---|---|---|
| | $M^{2+}$ | y1 | $M^{2+}$ | y2 | $M^{2+}$ | y3 | $M^{2+}$ | y4 | $M^{3+}$ | x1 | $M^{3+}$ | x2 | $M^{3+}$ | x3 |
| Hydrotalcite A *1 | Mg | 0.664 | Zn | 0.021 | Ca | 0.005 | Sr | 0.005 | Al | 0.290 | Fe | 0.010 | Ga | 0.005 |
| Hydrotalcite B *2 | Mg | 0.668 | Zn | 0.016 | Ca | 0.001 | — | — | Al | 0.300 | B | 0.015 | — | — |
| Hydrotalcite C *3 | Mg | 0.660 | Zn | 0.020 | Ca | 0.010 | — | — | Al | 0.290 | Ge | 0.020 | — | — |
| Hydrotalcite D *4 | Mg | 0.540 | Ca | 0.090 | Ni | 0.020 | Cu | 0.020 | Al | 0.310 | Fe | 0.018 | Ga | 0.002 |
| Hydrotalcite E *5 | Mg | 0.100 | Zn | 0.300 | Ca | 0.300 | — | — | Al | 0.300 | — | — | — | — |
| Hydrotalcite F *6 | Mg | 0.600 | Cd | 0.100 | — | — | — | — | Al | 0.300 | — | — | — | — |
| Hydrotalcite G *7 | Mg | 0.665 | Ca | 0.004 | — | — | — | — | Al | 0.330 | Fe | 0.001 | — | — |
| Hydrotalcite H *8 | Mg | 0.630 | Zn | 0.070 | — | — | — | — | Al | 0.300 | — | — | — | — |

| | $An^-$ | $An^-$ | $mH_2O$ | Surface-treated with a higher fatty acid |
|---|---|---|---|---|
| Hydrotalcite A *1 | $CO_3$ | Cl | 0.45 | Yes |
| Hydrotalcite B *2 | $CO_3$ | Cl | 0.34 | Yes |
| Hydrotalcite C *3 | $CO_3$ | Cl | 0.48 | Yes |
| Hydrotalcite D *4 | $CO_3$ | — | 0.45 | Yes |
| Hydrotalcite E *5 | $CO_3$ | — | 0.41 | Yes |
| Hydrotalcite F *6 | $CH_3COO$ | — | 0.34 | No |
| Hydrotalcite G *7 | $CO_3$ | — | 0.45 | Yes |
| Hydrotalcite H *8 | $CO_3$ | — | 0.42 | Yes |

*1: $Mg_{0.884}zN_{0.121}Ca_{0.005}Sr_{0.005}Al_{0.290}Fe_{0.010}Ga_{0.005}(OH)_2(CO)_{0.150}CL_{-0.005}.0.45H_2O$
*2: $Mg_{0.888}Zn_{0.016}Ca_{0.001}Al_{0.300}B_{0.015}(OH)_2(CO_3)_{0.150}CL_{-0.015}.0.34H_2O$
*3: $Mg_{0.880}Zn_{0.020}Ca_{0.010}Al_{0.290}Ge_{0.002}(OH)_2(CO_3)_{0.155}.0.48H_2O$
*4: $Mg_{0.54}Ca_{0.090}Ni_{0.020}Cu_{0.020}Al_{0.310}Fe_{0.018}Ga_{0.002}(OH)_2(CO_3)_{0.155}.0.48H_2O$
*5: $Mg_{0.100}Zn_{0.300}Ca_{0.200}Al_{0.300}(OH)_2(CO_3)_{0.150}.0.41H_2O$
*6: $Mg_{0.500}Cd_{0.100}Al_{0.300}(OH)_2(CH_3COO)_{0.300}.0.34H_2O$
*7: $Mg_{0.665}Ca_{0.004}Al_{0.330}Fe_{0.001}(OH)_2(CO_3)_{0.165}.0.45H_2O$
*8: $Mg_{0.630}Zn_{0.070}Al_{0.300}(OH)_2(CO_3)_{0.150}.0.42H_2O$

TABLE 3

| | | Assessment Results | | | | | | |
|---|---|---|---|---|---|---|---|---|
| | | Under a normal temperature and humidity atmosphere | | Quantity of charge on the toner (μC/g) durability-tested under a high temperature and humidity for 50 copies | | Quantity of charge on the toner (μC/g) durability-tested under a high temperature and humidity for 1000 copies | | Transferability Transfer current range in which transferability of at least 90% is secured |
| | Toner | Fogging | Dot repeatability | Solid white section | Solid black section | Solid white section | Solid black section | (μA) |
| Example 1 | 1 | 1.2 | A | 18.5 | 17.5 | 20.0 | 19.0 | 4–16 |
| Example 2 | 2 | 1.4 | A | 18.0 | 17.0 | 22.0 | 19.0 | 4–14 |
| Example 3 | 3 | 1.2 | B | 18.0 | 17.5 | 21.5 | 19.0 | 4–14 |
| Example 4 | 4 | 1.5 | B | 17.0 | 16.5 | 21.0 | 19.5 | 2–8 |
| Comparative example 1 | 5 | 2.7 | C | 15.0 | 13.0 | 22.0 | 16.0 | 8 |
| Comparative example 2 | 6 | 2.0 | D | 14.5 | 13.5 | 23.0 | 17.5 | 6–8 |
| Comparative example 3 | 7 | 1.8 | D | 14.0 | 13.0 | 20.0 | 16.0 | 8 |
| Example 5 | 8 | 1.9 | A | 18.0 | 17.2 | 20.0 | 18.5 | 4–12 |
| Comparative example 4 | 9 | 1.8 | C | 15.0 | 13.5 | 22.0 | 16.0 | 6–8 |
| Example 6 | 10 | 1.5 | B | 17.5 | 16.0 | 16.5 | 15.0 | 2–8 |
| Example 7 | 11 | 2.0 | C | 17.0 | 16.0 | 16.0 | 15.0 | 2–8 |
| Example 8 | 12 | 1.4 | A | 19.0 | 18.0 | 20.5 | 19.5 | 4–18 |

TABLE 4

| | SF-1 | SF-2 | SF-5 | Softening point of wax used (° C.) | Wax content (wt. parts) | Particle size (μm) | Number percentage of the particles having a size of 4.00 μm or less (%) |
|---|---|---|---|---|---|---|---|
| Black polymerized particles 1 | 110 | 111 | 105 | 72 | 10 | 7.1 | 20 |
| Black polymerized particles 2 | 117 | 115 | 104 | 115 | 10 | 7.0 | 28 |
| Black polymerized particles 3 | 123 | 124 | 104 | 75 | 50 | 7.2 | 22 |
| Black polymerized particles 4 | 119 | 123 | 106 | 143 | 10 | 7.5 | 22 |
| Black polymerized particles 5 | 118 | 116 | 107 | 75 | 10 | 9.2 | 10 |
| Black polymerized particles 6 | 116 | 113 | 106 | 75 | 10 | 6.7 | 25 |
| Black polymerized particles 7 | 125 | 121 | 109 | 75 | 10 | 5.5 | 45 |
| Black pulverized particles 1 | 172 | 156 | 118 | 115 | 5 | 9.8 | 21 |
| Black pulverized particles 2 | 153 | 135 | 111 | 115 | 5 | 9.9 | 17 |
| Black pulverized particles 3 | 160 | 147 | 113 | 115 | 5 | 8.0 | 25 |

TABLE 5

| | Toner | | SF-1 | SF-2 | SF-3 | Weight-average particle size (μm) | Number percentage of the particles having a size of 4.00 μm or less (%) | Toner acid value (mgKOH/g) | Incorporated with (wt. parts) |
|---|---|---|---|---|---|---|---|---|---|
| Example 9 | Toner 13 | Black polymerized particles 1 | 109 | 110 | 105 | 7.1 | 22 | 0 | Silica: 1.0, Hydrotalcite A: 0.3 |
| Example 10 | Toner 14 | Black polymerized particles 2 | 117 | 114 | 104 | 7.0 | 28 | 0 | Silica: 1.0, Hydrotalcite A: 0.3 |
| Example 11 | Toner 15 | Black polymerized particles 3 | 121 | 122 | 104 | 7.1 | 23 | 0 | Silica: 1.0, Hydrotalcite A: 0.3 |
| Example 12 | Toner 16 | Black polymerized particles 4 | 119 | 120 | 106 | 7.5 | 23 | 0 | Silica: 1.0, Hydrotalcite A: 0.3 |
| Example 13 | Toner 17 | Black polymerized particles 5 | 117 | 116 | 107 | 9.2 | 12 | 0 | Silica: 1.0, Hydrotalcite A: 0.3 |
| Example 14 | Toner 18 | Black polymerized particles 6 | 116 | 113 | 106 | 6.7 | 25 | 5 | Silica: 1.0, Hydrotalcite A: 0.3 |
| Example 15 | Toner 19 | Black polymerized particles 7 | 123 | 120 | 108 | 5.6 | 40 | 25 | Silica: 1.0, Hydrotalcite A: 0.3 |
| Example 16 | Toner 20 | Black polymerized particles 8 | 110 | 110 | 105 | 7.1 | 21 | 0 | Silica: 1.0, Hydrotalcite B: 0.3 |

TABLE 5-continued

| | | Toner | SF-1 | SF-2 | SF-3 | Weight-average particle size (μm) | Number percentage of the particles having a size of 4.00 μm or less (%) | Toner acid value (mgKOH/g) | Incorporated with (wt. parts) |
|---|---|---|---|---|---|---|---|---|---|
| Example 17 | Toner 21 | Black polymerized particles 1 | 109 | 109 | 105 | 7.1 | 22 | 0 | Silica: 1.0, Hydrotalcite C: 0.3 |
| Example 18 | Toner 22 | Black polymerized particles 1 | 109 | 109 | 105 | 7.1 | 21 | 0 | Silica: 1.0, Hydrotalcite D: 0.3 |
| Example 19 | Toner 23 | Black polymerized particles 1 | 110 | 109 | 105 | 7.1 | 21 | 0 | Silica: 1.0, Hydrotalcite G: 0.3 |
| Comparative example 5 | Toner 24 | Black polymerized particles 1 | 110 | 109 | 105 | 7.1 | 20 | 0 | Silica: 1.0 |
| Comparative example 6 | Toner 25 | Black polymerized particles 1 | 110 | 110 | 105 | 7.1 | 22 | 0 | Silica: 1.0, Hydrotalcite E: 0.3 |
| Example 20 | Toner 27 | Black pulverized particles 1 | 110 | 111 | 105 | 7.1 | 22 | 0 | Silica: 1.5, Hydrotalcite A: 0.5 |

TABLE 6

| | Under a high temperature and high temperature atmosphere | | | | |
|---|---|---|---|---|---|
| | Image concent-ration | Number of copies showing uneven charging on halftone images | | Quantity of toner attaching to the charging roll | Fogging on the photosensitive member |
| Example 9 | 1.42 | No uneven charges observed up to 1500th copy | No uneven charges observed up to 3000th copy | 0.21 | 0.07 |
| Example 10 | 1.44 | No uneven charges observed up to 1500th copy | No uneven charges observed up to 3000th copy | 0.15 | 0.05 |
| Example 11 | 1.43 | No uneven charges observed up to 1500th copy | No uneven charges observed up to 3000th copy | 0.28 | 0.02 |
| Example 12 | 1.45 | No uneven charges observed up to 1500th copy | No uneven charges observed up to 3000th copy | 0.18 | 0.05 |
| Example 13 | 1.45 | No uneven charges observed up to 1500th copy | No uneven charges observed up to 3000th copy | 0.19 | 0.02 |
| Example 14 | 1.42 | No uneven charges observed up to 1500th copy | No uneven charges observed up to 3000th copy | 0.20 | 0.03 |
| Example 15 | 1.40 | No uneven charges observed up to 1500th copy | No uneven charges observed up to 3000th copy | 0.25 | 0.05 |
| Example 16 | 1.40 | No uneven charges observed up to 1500th copy | No uneven charges observed up to 3000th copy | 0.23 | 0.07 |
| Example 17 | 1.40 | No uneven charges observed up to 1500th copy | No uneven charges observed up to 3000th copy | 0.22 | 0.06 |
| Example 18 | 1.41 | No uneven charges observed up to 1500th copy | No uneven charges observed up to 3000th copy | 0.25 | 0.07 |
| Example 19 | 1.43 | No uneven charges observed up to 1500th copy | Uneven charging slightly observed at 3000th copy | 0.30 | 0.03 |
| Comparative example 5 | 1.35 | Uneven charging slightly observed at 1500th copy | Uneven charging slightly observed at 3000th copy | 0.41 | 0.13 |
| Comparative example 6 | 1.38 | No uneven charging observed up to 1500th copy | Uneven charging slightly observed at 3000th copy | 0.32 | 0.09 |
| Comparative example 7 | 1.39 | No uneven charging observed up to 1500th copy | Uneven charging slightly observed at 3000th copy | | |
| Example 20 | 1.43 | No uneven charging observed up to 1500th copy | No uneven charging observed up to 3000th copy | 0.25 | 0.03 |

| | Under a high temperature and high humidity atmosphere | | Under a normal temperature and normal humidity atmosphere | |
|---|---|---|---|---|
| | Transferability | Resolution | Image concentration | Transferability |
| Example 9 | 0.05 | B | 1.45 | 0.01 |
| Example 10 | 0.02 | B | 1.46 | 0.02 |
| Example 11 | 0.02 | B | 1.46 | 0.01 |
| Example 12 | 0.02 | B | 1.45 | 0.03 |
| Example 13 | 0.04 | C | 1.45 | 0.01 |
| Example 14 | 0.02 | B | 1.45 | 0.01 |
| Example 15 | 0.05 | A | 1.44 | 0.01 |
| Example 16 | 0.03 | B | 1.42 | 0.01 |
| Example 17 | 0.03 | B | 1.41 | 0.01 |
| Example 18 | 0.03 | B | 1.41 | 0.01 |
| Example 19 | 0.06 | B | 1.45 | 0.01 |

TABLE 6-continued

| | | | | |
|---|---|---|---|---|
| Comparative example 5 | 0.08 | B | 1.40 | 0.08 |
| Comparative example 6 | 0.07 | B | 1.41 | 0.06 |
| Comparative example 7 | | | | |
| Example 20 | 0.04 | B | 1.46 | 0.01 |

TABLE 7

| | | Toner | SF-1 | SF-2 | SF-3 | Weight-average particle size (μm) | Number percentage of the particles having a size of 4.00 μm or less (%) | Toner acid value (mgKOH/g) | Incorporated with (wt. parts) |
|---|---|---|---|---|---|---|---|---|---|
| Example 22 | Toner 28 | Black pulverized particles 1 | 168 | 150 | 117 | 9.6 | 25 | 0 | Silica: 1.0, Hydrotalcite A: 0.3 |
| Example 23 | Toner 29 | Black pulverized particles 2 | 149 | 131 | 110 | 9.7 | 21 | 0 | Silica: 1.0, Hydrotalcite A: 0.3 |
| Comparative example 8 | Toner 30 | Black pulverized particles 2 | 150 | 132 | 111 | 9.7 | 20 | 0 | Silica: 1.0, Hydrotalcite A: 0.3 |

TABLE 8

| | Under a high temperature and high humidity atmosphere | | | Under a normal temperature and normal humidity atmosphere | |
|---|---|---|---|---|---|
| | Fogging on the photosensitive member | Transferability | Resolution | Image concentration | Transferability |
| Example 22 | 0.08 | 0.06 | C | 1.42 | 0.07 |
| Example 23 | 0.09 | 0.09 | B | 1.42 | 0.07 |
| Comparative example 8 | 0.11 | 0.18 | C | 1.40 | 0.15 |

What is claimed is:

1. A toner, comprising at least toner particles containing a binder resin and colorant, inorganic fine particles, and a hydrotalcite compound shown by the general formula (1):

$$M1_{y1}{}^{2+}M2_{y2}{}^{2+} \ldots Mj_{yj}{}^{2+}L1_{x1}{}^{3+}L2_{x2}{}^{3+} \ldots Lk_{xk}{}^{3+}(OH)_2.(X/n)\ A^{n-}.mH_2O \quad (1)$$

wherein $0<[X=(x1+x2+\ldots+xk)]\leqq 0.5$; $Y=(y1+y2+\ldots+yj)=1-X$; j and k are each an integer of 2 or larger; $M1^{2+}$, $M2^{2+}\cdots$ and $Mj^{2+}$ are divalent metallic ions different from each other; $L1^{3+}$, $L2^{3+}\cdots$ and $Lk^{3+}$ are trivalent metallic ions different from each other; $A^{n-}$ is a n-valent anion; and $m\geqq 0$.

2. The toner according to claim 1, wherein said hydrotalcite compound is shown by the general formula (2):

$$Mg_{y1}{}^{2+}M2_{y2}{}^{2+} \ldots Mj_{yj}{}^{2+}Al_{x1}{}^{3+}L2_{x2}{}^{3+} \ldots Lk_{xk}{}^{3+}(OH)_2.(X/n)\ A^{n-}.mH_2O \quad (2)$$

wherein $0<[X=(x1+x2+\ldots+xk)]\leqq 0.5$; $Y=(y1+y2+\ldots+yj)=1-X$; j and k are each an integer of 2 or larger; M2, M3, . . . Mj are each selected from the group consisting of Zn, Ca, Ba, Ni, Sr, Cu and Fe, and are different from each other; L2, L3, . . . Lk are each selected from the group consisting of B, Ga, Fe, Co and In, and are different from each other; $A^{n-}$ is a n-valent anion; and $m\geqq 0$.

3. The toner according to claim 2, wherein the relationship $y1>y2+\ldots+yj$ holds in the general formula (2).

4. The toner according to claim 2, wherein the relationship $x1>x2+\ldots+xk$ holds in the general formula (2).

5. The toner according to claim 2, wherein the relationship $y1>10\times(y2+\ldots+yj)$ holds in the general formula (2).

6. The toner according to claim 2, wherein the relationship $x1>10\times(x2+\ldots+xk)$ holds in the general formula (2).

7. The toner according to claim 2, wherein the relationship $0.9\leqq x1+y1<1.0$ holds in the general formula (2).

8. The toner according to claim 2, wherein the relationship $0.930\leqq x1+y1\leqq 0.998$ holds in the general formula (2).

9. The toner according to claim 2, wherein the relationship $0.001\leqq y2+\ldots+yj\leqq 0.05$ holds in the general formula (2).

10. The toner according to claim 2, wherein the relationship $0.0003\leqq x2+\ldots+xk\leqq 0.02$ holds in the general formula (2).

11. The toner according to claim 1, wherein said hydrotalcite compound is hydrophobicizing-treated with a surface treatment agent.

12. The toner according to claim 1, which has a weight-average particle size of 3 to 10 μm.

13. The toner according to claim 1, wherein the relationship $\exp 5.9\times X^{-2.3}\leqq Y\leqq \exp 9.1\times X^{-2.9}$ holds X is weight-average particle size of the toner (μm) and Y is ratio (or percentage) of number of the particles having a number-based particle size of 2.00 to 4.00 μm, determined from particle number distribution, to the total number of the particles, and are in the following ranges:

X: 4.0 to 10.0 μm, and Y<100.

14. The toner according to claim 1, wherein its shape factor SF-1 is in the following range:

$100<SF\text{-}1\leqq 160$.

15. The toner according to claim 1, wherein its shape factor SF-1 is in the following range:

$100<SF\text{-}1\leqq 140$.

16. The toner according to claim 1, wherein its shape factor SF-1 is in the following range:

$100<SF\text{-}1<120$.

17. The toner according to claim 1, wherein its shape factor SF-2 is in the following range:

$100<SF\text{-}2\leqq 140$.

18. The toner according to claim 1, wherein its shape factor SF-2 is in the following range:

$100<SF\text{-}2\leqq 130$.

19. The toner according to claim 1, wherein its shape factor SF-2 is in the following range:

$100<SF\text{-}2<115$.

20. The toner according to claim 1, wherein its shape factor SF-5 is in the following range:

$100<SF\text{-}5\leqq 110$.

21. The toner according to claim 1, wherein said binder resin has an acid value of 1.0 to 40.0 mgKOH/g.

22. The toner according to claim 1, wherein said binder resin has an acid value of 1.0 to 35.0 mgKOH/g.

23. The toner according to claim 1, wherein said binder resin has an acid value of 2.0 to 30.0 mgKOH/g.

24. The toner according to claim 1, wherein said inorganic fine particles are of a compound selected from the group consisting of silica, alumina, titania and a double oxide thereof.

25. The toner according to claim 1, wherein said inorganic fine particles are hydrophobicizing-treated.

26. The toner according to claim 1, wherein said inorganic fine particles are hydrophobicizing-treated with silicone oil.

27. The toner according to claim 1, wherein said inorganic fine particles are hydrophobicizing-treated first with a silane coupling agent and then with silicone oil.

28. The toner according to claim 1, which has negatively chargeability.

29. The toner according to claim 1, which is incorporated with a compound selected from the group consisting of strontium titanate, calcium titanate and cerium titanate.

30. The toner according to claim 1, wherein said hydrotalcite compound is $Mg_{0.664}Zn_{0.021}Ca_{0.005}Sr_{0.005}Al_{0.290}Fe_{0.010}Ga_{0.005}(OH)_2(CO_3)_{0.0150}Cl_{0.005}0.45H_2O$.

31. The toner according to claim 1, wherein said hydrotalcite compound is $Mg_{0.668}Zn_{0.016}Ca_{0.001}Al_{0.300}B_{0.015}(OH)_2(CO_3)_{0.150}Cl_{0.015}0.34H_2O$.

32. The toner according to claim 1, wherein said hydrotalcite compound is $Mg_{0.660}Zn_{0.020}Ca_{0.010}Al_{0.290}Ge_{0.020}(OH)_2(CO_3)_{0.150}Cl_{0.010}0.48H_2O$.

33. The toner according to claim 1, wherein said hydrotalcite compound is $Mg_{0.540}Ca_{0.090}Ni_{0.020}Cu_{0.020}Al_{0.310}Fe_{0.018}Ga_{0.002}(OH)_2(CO_3)_{0.165}0.45H_2O$.

34. The toner according to claim 1, wherein said hydrotalcite compound is $Mg_{0.665}Ca_{0.004}Al_{0.330}Fe_{0.001}(OH)_2(CO_3)_{0.165}0.45H_2O$.

35. An image forming method, comprising at least a charging step which charges an image carrier; latent image forming step which forms an electrostatic latent image on the charged image carrier; developing step which develops the electrostatic latent image with a toner carried by a toner carrier, to form the toner image on the image carrier; transfer step which transfers the toner image on the image carrier to a medium through or not through an intermediate medium; and fixing step which fix the toner image on the transfer medium, wherein said toner comprises at least toner particles containing a binder resin and colorant, inorganic fine particles, and a hydrotalcite compound shown by the general formula (1):

$$M1_{y1}^{2+}M2_{y2}^{2+}\ldots Mj_{yj}^{2+}L1_{x1}^{3+}L2_{x2}^{3+}\ldots Lk_{xk}^{3+}(OH)_2.(X/n)A^{n-}.mH_2O \quad (1)$$

wherein $0<[X=(x1+x2+\ldots+xk)]\leqq 0.5$; $Y=(y1+y2+\ldots+yj)=1-X$; j and k are each an integer of 2 or larger; $M1^{2+}$, $M2^{2+}\ldots$ and $Mj^{2+}$ are divalent metallic ions different from each other; $L1^{3+}$, $L2^{3+}\ldots$ and $Lk^{3+}$ are trivalent metallic ions different from each other; $A^{n-}$ is a n-valent anion; and $m\geqq 0$.

36. The image forming method according to claim 35, wherein said hydrotalcite compound is shown by the general formula (2):

$$Mg_{y1}^{2+}M2_{y2}^{2+}\ldots Mj_{yj}^{2+}Al_{x1}^{3+}L2_{x2}^{3+}\ldots Lk_{xk}^{3+}(OH)_2.(X/n)A^{n-}.mH_2O \quad (2)$$

wherein $0<[X=(x1+x2+\ldots+xk)]<0.5$; $Y=(y1+y2+\ldots+yj)=1-X$; j and k are each an integer of 2 or larger; M2, M3, . . . Mj are each selected from the group consisting of Zn, Ca, Ba, Ni, Sr, Cu and Fe, and are different from each other; L2, L3, . . . Lk are each selected from the group consisting of B, Ga, Fe, Co and In, and are different from each other; $A^{n-}$ is a n-valent anion; and $m\geqq 0$.

37. The image forming method according to claim 36, wherein the relationship $y1>y2+\ldots+yj$ holds in the general formula (2).

38. The image forming method according to claim 36, wherein the relationship $x1>x2+\ldots+xk$ holds in the general formula (2).

39. The image forming method according to claim 36, wherein the relationship $y1>10\times(y2+\ldots+yj)$ holds in the general formula (2).

40. The image forming method according to claim 36, wherein the relationship $x1>10\times(x2+\ldots+xk)$ holds in the general formula (2).

41. The image forming method according to claim 36, wherein the relationship $0.9\leqq x1+y1>1.0$ holds in the general formula (2).

42. The image forming method according to claim 36, wherein the relationship $0.930\leqq x1+y1\leqq 0.998$ holds in the general formula (2).

43. The image forming method according to claim 36, wherein the relationship $0.001\leqq y2+\ldots+yj\leqq 0.05$ holds in the general formula (2).

44. The image forming method according to claim 36, wherein the relationship $0.0003 \leqq x2 + \ldots + xk \leqq 0.02$ holds in the general formula (2).

45. The image forming method according to claim 35, wherein said hydrotalcite compound is hydrophobicizing-treated with a surface treatment agent.

46. The image forming method according to claim 35, which said toner has a weight-average particle size of 3 to 10 $\mu$m.

47. The image forming method according to claim 35, wherein the relationship $\exp 5.9 \times X^{-2.3} \leqq Y \leqq \exp 9.1 \times X^{-2.9}$ holds X is weight-average particle size of the toner ($\mu$m) and Y is ratio (or percentage) of number of the particles having a number-based particle size of 2.00 to 4.00 $\mu$m, determined from particle number distribution, to the total number of the particles, and are in the following ranges:

X: 4.0 to 10.0 $\mu$m, and $Y<100$.

48. The image forming method according to claim 35, wherein its shape factor SF-1 is in the following range:

$100<SF\text{-}1 \leqq 160$.

49. The image forming method according to claim 35, wherein its shape factor SF-1 is in the following range:

$100<SF\text{-}1 \leqq 140$.

50. The image forming method according to claim 35, wherein its shape factor SF-1 is in the following range:

$100<SF\text{-}1<120$.

51. The image forming method according to claim 35, wherein its shape factor SF-2 is in the following range:

$100<SF\text{-}2 \leqq 140$.

52. The image forming method according to claim 35, wherein its shape factor SF-2 is in the following range:

$100<SF\text{-}2 \leqq 130$.

53. The image forming method according to claim 35, wherein its shape factor SF-2 is in the following range:

$100<SF\text{-}2<115$.

54. The image forming method according to claim 35, wherein its shape factor SF-5 is in the following range:

$100<SF\text{-}5 \leqq 110$.

55. The image forming method according to claim 35, wherein said binder resin has an acid value of 1.0 to 40.0 mgKOH/g.

56. The image forming method according to claim 35, wherein said binder resin has an acid value of 1.0 to 35.0 mgKOH/g.

57. The image forming method according to claim 35, wherein said binder resin has an acid value of 2.0 to 30.0 mgKOH/g.

58. The image forming method according to claim 35, wherein said inorganic fine particles are of a compound selected from the group consisting of silica, alumina, titania and a double oxide thereof.

59. The image forming method according to claim 35, wherein said inorganic fine particles are hydrophobicizing-treated.

60. The image forming method according to claim 35, wherein said inorganic fine particles are hydrophobicizing-treated with silicone oil.

61. The image forming method according to claim 35, wherein said inorganic fine particles are hydrophobicizing-treated first with a silane coupling agent and then with silicone oil.

62. The image forming method according to claim 35, wherein said toner has negatively chargeability.

63. The image forming method according to claim 35, wherein said toner is incorporated with a compound selected from the group consisting of strontium titanate, calcium titanate and cerium titanate.

64. The image forming method according to claim 35, wherein said developing step is effected by bringing the electrostatic latent image on the image carrier and the toner layer over the toner carrier into contact with each other.

65. The image forming method according to claim 64, wherein said toner carrier is an elastic roll.

66. The image forming method according to claim 64, wherein said developing step uses a DC voltage as the bias to be applied to the toner carrier.

67. The image forming method according to claim 64, wherein said developing step involves recovery of the residual toner left on the image carrier by the transfer step when the electrostatic latent image is developed.

68. The image forming method according to claim 35, wherein said charging step is effected by bringing the charging member into contact with, or close to, the image carrier.

69. The image forming method according to claim 68, wherein said toner charging member is an elastic roll.

70. The image forming method according to claim 68, wherein said charging step uses a DC voltage as the bias to be applied to the charging member.

71. The image forming method according to claim 35, wherein said hydrotalcite compound is $Mg_{0.664}Zn_{0.021}Ca_{0.005}Sr_{0.005}Al_{0.290}Fe_{0.010}Ga_{0.005}(OH)_2(CO_3)_{0.150}Cl_{0.005}0.45H_2O$.

72. The image forming method according to claim 35, wherein said hydrotalcite compound is $Mg_{0.668}Zn_{0.016}Ca_{0.001}Al_{0.300}B_{0.015}(OH)_2(CO_3)_{0.150}Cl_{0.015}0.34H_2O$.

73. The image forming method according to claim 35, wherein said hydrotalcite compound is $Mg_{0.660}Zn_{0.020}Ca_{0.010}Al_{0.290}Ge_{0.020}(OH)_2(CO_3)_{0.150}Cl_{0.010}0.48H_2O$.

74. The image forming method according to claim 35, wherein said hydrotalcite compound is $Mg_{0.540}Ca_{0.090}Ni_{0.020}Cu_{0.020}Al_{0.310}Fe_{0.018}Ga_{0.002}(OH)_2(CO_3)_{0.165}0.45H_2O$.

75. The image forming method according to claim 35, wherein said hydrotalcite compound is $Mg_{0.665}Ca_{0.004}Al_{0.330}Fe_{0.001}(OH)_2(CO_3)_{0.165}0.45H_2O$.

* * * * *

UNITED STATES PATENT AND TRADEMARK OFFICE

CERTIFICATE OF CORRECTION

PATENT NO. : 6,214,509 B1
DATED : April 10, 2001
INVENTOR(S) : Takashige Kasuya et al.

It is certified that error appears in the above-identified patent and that said Letters Patent is hereby corrected as shown below:

Title page,
Item [56], FOREIGN PATENT DOCUMENTS, "2-14156 8/19900 (JP) should read -- 2-214156 8/19900 (JP) --.

Column 3,
Line 45, "loose" should read -- loss --.

Column 5,
Line 4, "loose" should read -- loss --.

Column 6,
Line 45, "metals," should read -- metal, --.

Column 9,
Line 44, "highly" should read -- high --.

Column 13,
Line 49, "has" should read -- have --.

Column 14,
Line 58, "mixed" should read -- mixed with --.

Column 24,
Line 33, "vias" should read -- bias --.

Column 26,
Line 25, "leas" should read -- less --.

Column 37,
Table 1 (in Example 8), "disilazand" should read -- disilazane --; and
Table 2, "*3:$Mg_{0.880}Zn_{0.020}Ca_{0.010}Al_{0.290}Ge_{0.002}(OH)_2(CO_3)_{0.155}.0.48H_2O$" should read -- *3:$Mg_{0.880}Zn_{0.020}Ca_{0.010}Al_{0.290}Ge_{0.020}(OH)_2(CO_3)_{0.150}.CL_{0.010}.0.48H_2O$ --.

Column 39,
Table 5 after SF-2, "SF-3" should read -- SF-5 --; and
Table 5 (in Example 16), "Black polymerized particles 8" should read -- Black polymerized particels 1 --.

UNITED STATES PATENT AND TRADEMARK OFFICE

CERTIFICATE OF CORRECTION

PATENT NO. : 6,214,509 B1
DATED : April 10, 2001
INVENTOR(S) : Takashige Kasuya et al.

It is certified that error appears in the above-identified patent and that said Letters Patent is hereby corrected as shown below:

Column 41,
Table 6, "Under a high temperature and high temperature atmosphere" should read -- Under a high temperature and high humidity atmosphere --; and "charges" (all occurrences) should read -- charging --.

Column 43,
Table 7 after SF-2, "SF-3" should read -- SF-5 --.

Column 45,
Line 54, "negatively" should read -- negative --.

Column 48,
Line 14, "negatively" should read -- negative --.

Signed and Sealed this

Twenty-eighth Day of May, 2002

*Attest:*

*Attesting Officer*

JAMES E. ROGAN
*Director of the United States Patent and Trademark Office*